US007665162B2

(12) United States Patent
Peer

(10) Patent No.: US 7,665,162 B2
(45) Date of Patent: Feb. 23, 2010

(54) KIT AND ASSEMBLY USEFUL FOR INFANTS

(76) Inventor: Guy Peer, 108 Hagalif St., Nofit 36001 (IL)

( * ) Notice: Subject to any disclaimer, the term of this patent is extended or adjusted under 35 U.S.C. 154(b) by 215 days.

(21) Appl. No.: 11/357,037

(22) Filed: Feb. 21, 2006

(65) Prior Publication Data

US 2006/0185081 A1 Aug. 24, 2006

(30) Foreign Application Priority Data

Feb. 22, 2005 (IL) ..... 167047

(51) Int. Cl.
*A47D 7/01* (2006.01)
*A47D 13/06* (2006.01)
*A47C 19/04* (2006.01)

(52) U.S. Cl. ..... 5/93.1; 5/201; 5/282.1; 5/285; 5/288

(58) Field of Classification Search ..... 5/93.1, 5/99.1, 100, 2.1, 9.1, 200.1, 201, 279.1, 282.1, 5/283, 288, 292, 296, 285
See application file for complete search history.

(56) References Cited

U.S. PATENT DOCUMENTS

| | | | | | |
|---|---|---|---|---|---|
| 5,650 | A | * | 6/1848 | Lewis | 5/302 |
| 6,275 | A | * | 4/1849 | Sanborn | 5/292 |
| 895,898 | A | * | 8/1908 | Scheer | 5/9.1 |
| 911,863 | A | * | 2/1909 | Adams | 5/283 |
| 959,093 | A | * | 5/1910 | Wilson | 5/283 |
| 960,340 | A | * | 6/1910 | Kimball | 5/283 |
| 998,582 | A | * | 7/1911 | Lucas | 285/191 |
| 1,070,814 | A | * | 8/1913 | Kimball | 5/283 |
| 1,114,486 | A | * | 10/1914 | Kimball | 5/283 |
| 1,352,594 | A | * | 9/1920 | Gail | 5/283 |
| 1,425,718 | A | * | 8/1922 | Sussman | 5/283 |
| 1,486,826 | A | * | 3/1924 | Atkinson | 5/283 |
| 2,348,012 | A | * | 5/1944 | Levi | 256/25 |
| 2,451,431 | A | | 10/1948 | Bible | |
| 3,181,923 | A | * | 5/1965 | Guillon et al. | 312/351.3 |
| RE26,105 | E | * | 11/1966 | Guillon et al. | 312/351.3 |
| 3,427,669 | A | * | 2/1969 | Swenson | 5/93.1 |
| 3,900,907 | A | | 8/1975 | Mulder | |
| 3,972,638 | A | * | 8/1976 | Vivoli | 403/174 |
| 4,065,818 | A | * | 1/1978 | Farina | 5/288 |
| 4,155,131 | A | * | 5/1979 | Harris et al. | 5/296 |
| 4,223,413 | A | * | 9/1980 | Dresher et al. | 5/282.1 |
| 4,299,509 | A | * | 11/1981 | Meickl | 403/252 |

(Continued)

FOREIGN PATENT DOCUMENTS

| | | |
|---|---|---|
| DE | 2 229 052 | 12/1973 |

(Continued)

*Primary Examiner*—Robert G Santos
(74) *Attorney, Agent, or Firm*—The Nath Law Group; Derek Richmond; Jiaxiao Zhang

(57) ABSTRACT

A kit is provided for enabling the assembly of structures useful for infants, for example playpens and cribs. The kit includes a plurality of cross-members, bars and corner modules. Each bar is in the form of at least one upright having spacer elements at longitudinal ends thereof. The cross-members have a longitudinal open slot for engaging a plurality of such bars via their spacer elements received in the slot serially. Each corner module is adapted for clamping together at least two said cross-members, or for retaining the spacer elements within the slot.

22 Claims, 18 Drawing Sheets

U.S. PATENT DOCUMENTS

| | | | | |
|---|---|---|---|---|
| 4,491,992 | A | 1/1985 | Wittman | |
| 5,134,732 | A * | 8/1992 | Li | 5/93.1 |
| 5,517,744 | A * | 5/1996 | Moser et al. | 29/525 |
| 5,655,234 | A * | 8/1997 | Randleas | 5/9.1 |
| 5,803,645 | A * | 9/1998 | Moser et al. | 403/243 |
| 5,983,420 | A * | 11/1999 | Tilley | 5/2.1 |
| 6,018,829 | A * | 2/2000 | Rosenquist | 5/9.1 |
| 6,098,217 | A | 8/2000 | Hammil | |
| 6,167,579 | B1 * | 1/2001 | Kopish | 5/2.1 |
| 6,292,959 | B1 * | 9/2001 | Rosenquist | 5/9.1 |
| 6,314,595 | B1 * | 11/2001 | Price | 5/201 |
| 7,111,341 | B2 * | 9/2006 | Hennings et al. | 5/201 |
| 2005/0273929 | A1 * | 12/2005 | Hennings et al. | 5/201 |
| 2006/0185081 | A1 * | 8/2006 | Peer | 5/93.1 |

FOREIGN PATENT DOCUMENTS

| | | | |
|---|---|---|---|
| DE | 3410863 | A1 * | 11/1985 |
| EP | 0 508 729 | A1 | 10/1992 |
| WO | 03/070033 | A2 | 8/2003 |

* cited by examiner

KIT AND ASSEMBLY USEFUL FOR INFANTS

FIELD OF THE INVENTION

This invention relates to structures useful for infants, including child enclosures such as playpens, cribs and the like.

BACKGROUND OF THE INVENTION

Cribs, playpens, play dens and the like, referred to herein collectively as "infant enclosures" or as "enclosures" are well known, and allow a baby, toddler, infant or small child (referred to herein collectively as "infant") to be confined comfortably to a limited area, without danger of the infant leaving the area on his own. Such enclosures are typically adapted for enabling the infant to play and/or sleep and/or be transported therein.

Conventionally, such enclosures comprise four vertical panels joined together to form a rectangular assembly, and further comprise a bottom panel, mat or mattress, according to the specific use of the enclosure. The panels are typically preformed and may be assembled to form the crib, playpen or play den by trained personnel or by the home owner. In cribs, two opposite panels are typically solid in appearance, comprising the ends of the cribs, and the remaining two panels—comprising the sides of the crib—comprise a plurality of spaced bars or a net. Playpens or play dens typically comprise four similar panels, forming a square or rectangle plan form, the panels comprising netting or a plurality of spaced vertical bars.

Some known infant enclosures provide advantages in flexibility of use and/or assembly thereof.

For example, U.S. Pat. No. 4,491,992 discloses an adjustable-sized crib that may be assembled and disassembled, and comprises a rather large number of different sized plastic tube sections and different types of tube end fittings that are connected together in a particular manner to form a four-walled barred crib-playpen. The crib-playpen has no vertical corner members, but comprises a strut subassembly support, also assembled from particular tube sections and tube end fittings, for a crib bottom board.

U.S. Pat. No. 3,900,907 discloses a plastic baby crib made from a variety of plastic elements. Two crib ends each comprise a pair of uprights horizontally spaced by a pair of cross-members and a solid panel therebetween. Two crib sides are each made from a pair of vertically spaced horizontal cross members joined by a plurality of horizontally spaced vertical bars that fit in facing holes provided in the cross members. The uprights and the cross members a uniform lateral cross-section and consist of a hollow substantially rectangular extrusion having at least one internal partition web.

U.S. Pat. No. 6,098,217 discloses a modular playpen which may be reconfigured in a variety of shapes and which may be assembled and disassembled manually. The playpen consists of five basic parts including: a plurality of rectangular side panels comprising a plastic frame supporting nylon mesh; a plurality of vertical uprights, one pair thereof slidably affixed to each end of a side panel via a longitudinal groove extending to a large portion of the length of each upright to form an enclosure; a series of horizontal support bars removably engaged to the lower portion of each upright; floor pads positioned within the enclosure and over the support bars; a central post to provide additional support for the floor pads.

SUMMARY OF THE INVENTION

The present invention is directed to a kit for assembling structures useful for infants, comprising a plurality of each one of cross-members, bars and corner modules, wherein:

- each said bar comprises at least one upright having spacer elements at longitudinal ends thereof;
- each said cross-member comprises a longitudinal open slot for engaging a plurality of said bars at one end thereof therewith, said slot adapted for receiving therein a corresponding plurality of said spacer elements in series; and
- each said corner module is adapted for clamping together at least two said cross-members.

The corner modules are further adapted for retaining said spacer elements longitudinally with respect to said slot when the various modular elements of the kit are assembled.

The cross-members comprise an engagement element at each longitudinal end thereof, and said corner modules comprise a clamping arrangement comprising a pair or mutually engageable clamping members, wherein one said clamping member of each said pair comprises at least two suitable slots, each adapted for engaging a said engagement element of a corresponding said cross-member.

Optionally, the corner modules comprise a strut element comprising at each longitudinal end thereof a said clamping arrangement.

Typically, the cross-members comprise a substantially uniform transverse profile along a longitudinal length thereof between said engagement elements. The slot typically comprises a transverse cross sectional profile including any one of: T-shaped, trapezoidal, circular, cross-shaped, crescent-shaped, asymmetrical, and so on.

Similarly, the engagement element typically comprises a plan form including any one of: T-shaped, trapezoidal, circular, cross-shaped, crescent-shaped, asymmetrical, and so on.

Optionally, at least one said cross-member is formed as a continuous extrusion of uniform cross-section, and wherein said engagement members are formed by applying a material removal operation to longitudinal ends of said cross-member.

The spacer elements comprise a transverse cross sectional profile adapted for retaining said spacer elements in said slot in directions other than the longitudinal direction of said slot. At least one said bar may be in the form of any one of a symmetrical or asymmetrical H, a Z, a symmetrical or asymmetrical U, wave, zig-zag, flower, toy, clown, teddy bears, tree, panel, slat, net, mesh and so on, wherein said spacer elements thereof are substantially orthogonal to said upright thereof. Alternatively, at least one said bar is in the form of a panel or net having a width substantially similar to the said spacer elements thereof.

Where the bars are substantially asymmetrical about a longitudinal axis thereof, the channel of the cross-members may comprise an asymmetrical cross-sectional profile, and said spacer elements are adapted for being received in said channel in one longitudinal direction only.

The spacer elements preferably provide a predetermined spacing between said uprights when corresponding said bars are engaged in said cross-members.

Optionally, the kit further comprises an entertainment panel comprising a width corresponding to a multiple of the width of a said bar, and further comprising spacer members for engagement with said cross-members.

Optionally, the kit further comprises a plurality of auxiliary spacer element adapted for being engaged between two adjacent said bars and having a longitudinal length smaller than the longitudinal length of said bars, and a platform having a plurality of tabs adapted for being seated onto said auxiliary spacer elements when an infant enclosure is assembled comprising said auxiliary spacer elements.

Optionally, the kit further comprises any one of leg elements, wheel elements and an arcuate base, each adapted for connection to said corner modules, for supporting an enclosure made by assembling elements of said kit.

Optionally, the kit comprises at least one type of a plurality of types of said corner module, each said type of corner module comprising a clamping arrangement comprising a pair or mutually engageable clamping members and characterized in that one said clamping member of each said pair comprises a particular slot arrangement comprising at least one slot, each slot adapted for engaging a said engagement element of a corresponding said cross-member in a particular orientation with respect to the clamping member.

Optionally, the kit further comprises hinge members adapted for cooperating with said corner modules for enabling said corner modules to pivot with respect to said hinge members when assembled therewith, said hinge members further adapted for mounting to a substantially vertical surface.

Optionally, the kit further comprises latch members adapted for cooperating with said corner modules for enabling said corner modules to be restrained with respect to said latch members when engaged therewith, said hinge members further adapted for mounting to a substantially vertical surface.

The present invention also relates to a kit for assembling structures useful for infants, comprising a plurality of cross-members, bars and corner modules, wherein:

each said bar comprises an upright having spacer elements at longitudinal ends thereof;

each said cross-member comprises a longitudinal open slot for engaging a plurality of said bars at one end thereof therewith, said slot adapted for receiving therein a corresponding plurality of said spacer elements in series;

each said corner module comprises a clamping arrangement for at least retaining said spacer elements longitudinally with respect to said slot.

Optionally, the kit further comprises hinge members adapted for cooperating with said corner modules for enabling said corner modules to pivot with respect to said hinge members when assembled therewith, said hinge members further adapted for mounting to a substantially vertical surface. Further optionally, the kit further comprises latch members adapted for cooperating with said corner modules for enabling said corner modules to be restrained with respect to said latch members when engaged therewith, said latch members further adapted for mounting to a substantially vertical surface.

The present invention also relates to a structure useful for infants, said structure comprising an assembly of bars, cross-members and corner modules, wherein each said bar comprises at least one upright having spacer elements at longitudinal ends thereof;

each said cross-member comprises a longitudinal open slot for engaging a plurality of said bars at one end thereof therewith, said slot adapted for receiving therein a corresponding plurality of said spacer elements in series;

each said corner module is adapted for clamping together at least two said cross-members; and wherein said structure comprises a plurality of panel assemblies joined by means of said corner modules, wherein each said panel assembly comprises a plurality of said bars serially engaged longitudinally with respect to a pair of spaced said cross-members by means of engagement of the said spacer elements of each said bar with a channel of one or another of said cross-members.

The bars, cross-members and corner modules, are typically assembled from a kit comprising the same according to the invention, or may be assembled from such elements that are not provided in kit form.

The structure may comprise a platform adapted for being received in said enclosure and for being supported with respect to said auxiliary spacer elements.

The structure may be supported on a surface by means of any one of leg elements, wheel elements and an arcuate base.

The structure may optionally comprise a strap arrangement attached to a bottom end of said enclosure and adapted for securing the enclosure to a bed or other raised platform. Optionally, suitable pegs may be provided for securing a bottom end of said enclosure to soft ground.

The structure may optionally further comprise at least one of: a night light, a mobile, and active and/or passive play center, mirror.

The present invention is also directed to a structure useful for infants, said structure comprising an assembly of bars, cross-members and corner modules, wherein each said bar comprises an upright having spacer elements at longitudinal ends thereof;

each said cross-member comprises a longitudinal open slot for engaging a plurality of said bars at one end thereof therewith, said slot adapted for receiving therein a corresponding plurality of said spacer elements in series;

each said corner module is adapted for clamping together at least two said cross-members; and wherein said structure is adapted for use as a gate and comprises a panel assembly having a plurality of said bars serially engaged longitudinally with respect to a pair of spaced said cross-members by means of engagement of the said spacer elements of each said bar with a channel of one or another of said cross-members, and further comprising one said corner module for securing the said bars longitudinally with respect to said channels.

This structure further comprises hinge members adapted for cooperating with said corner modules for enabling said corner modules to pivot with respect to said hinge members when assembled therewith, said hinge members further adapted for mounting to a substantially vertical surface, as well as latch members adapted for cooperating with said corner modules for enabling said corner modules to be restrained with respect to said latch members when engaged therewith, said latch members further adapted for mounting to a substantially vertical surface.

The present invention is also directed to an element adapted for use in the assembly of structures useful for infants, said element comprising any one of a cross-member, a bar and a corner module, wherein:

said bar comprises an upright having spacer elements at longitudinal ends thereof, said spacer elements being adapted for being engaged in a longitudinal open slot of a cross-member;

said cross-member comprises a longitudinal open slot for engaging a plurality of bars having spacer elements at the ends thereof via said spacer elements, said slot adapted for receiving therein a corresponding plurality of said spacer elements in series, said cross-member further comprising an engagement at each longitudinal end thereof; and said corner module comprising a clamping arrangement comprising a pair or mutually engageable clamping members, wherein one said clamping member of each said pair comprises at least two suitable slots, each adapted for engaging an engagement element of a corresponding said cross-member.

The present invention is also directed to a method for assembling a structure useful for infants, comprising:

(i) providing a plurality of bars, cross-members and corner modules, wherein:

each said bar comprises an upright having spacer elements at longitudinal ends thereof;

each said cross-member comprises a longitudinal open slot for engaging a plurality of said bars at one end thereof therewith, said slot adapted for receiving therein a corresponding plurality of said spacer elements in series;

each said corner module is adapted for clamping together at least two said cross-members;

(ii) assembling a plurality of panel assemblies by serially engaging a plurality of said bars longitudinally with respect to a pair of spaced said cross-members by means of engagement of the said spacer elements of each said bar with a channel of one or another of said cross-members; and (iii) joining each pair of adjacent said panel assemblies by means of said corner modules.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF THE INVENTION

Figure 1:
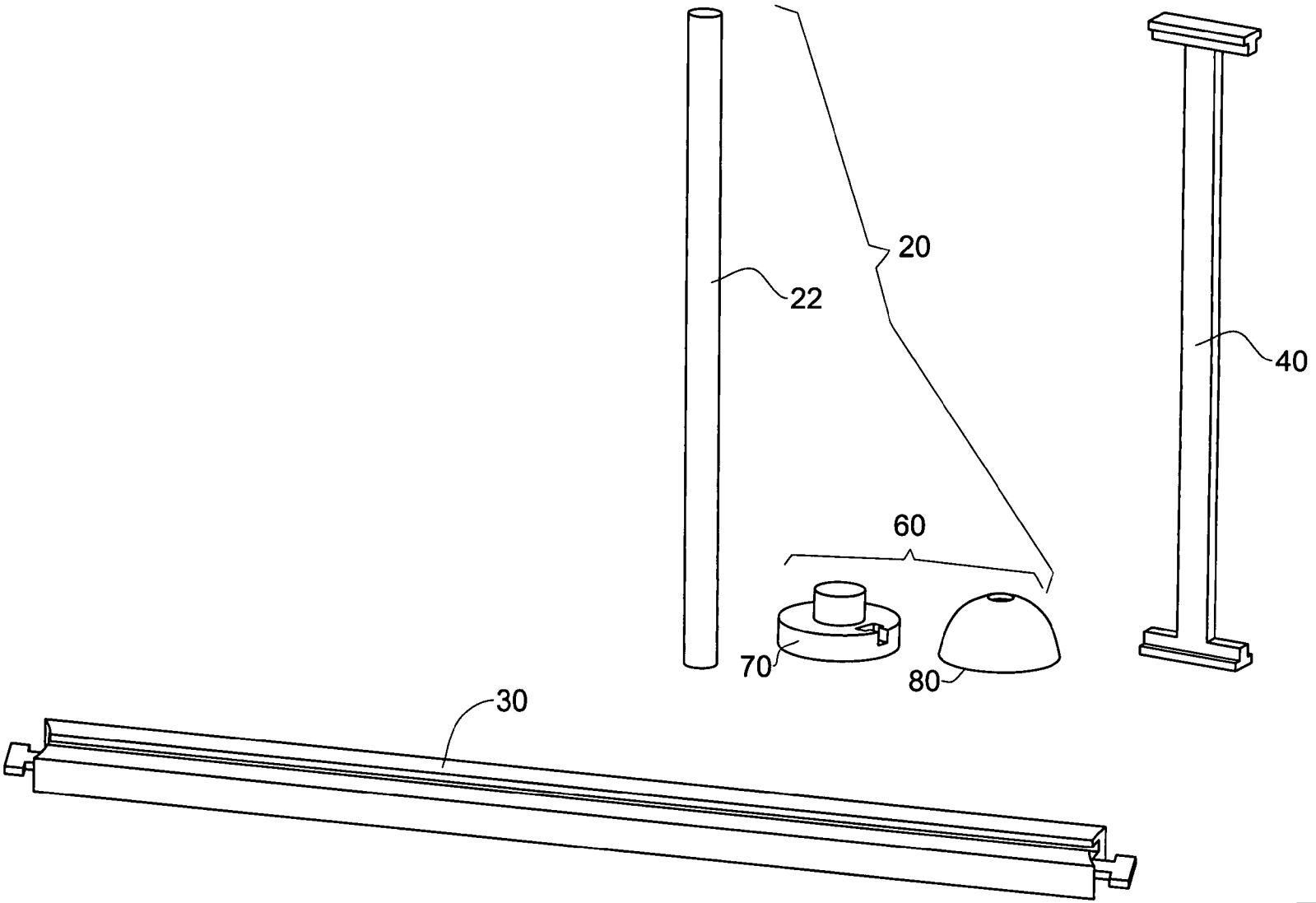
FIG. 1 is a perspective view of the five basic elements comprised in a first embodiment of the kit of the invention.

FIG. 1 illustrates the basic modular components of a kit 50 according to a first embodiment of the invention, which may be used to assemble therefrom a variety of structures useful for infants. According to a first aspect of the invention, and referring to FIG. 2, the kit 50 may be used to assemble an infant enclosure, generally designated with the numeral 10.

The kit 50 comprises a number of each of three basic components which are modular in form, allowing structures with multiple permutations and combinations of these components to be assembled: corner modules 20 (which comprise clamping parts 70, 80); cross-members 30; and bars 40. While the enclosure 10 is configured as a rectangular playpen or crib in FIG. 2, it may be reconfigured into a variety of different shapes by optionally employing a modification of one of the clamping parts, and varying the special relationship between the various components, as will become clearer herein.

Figure 3:
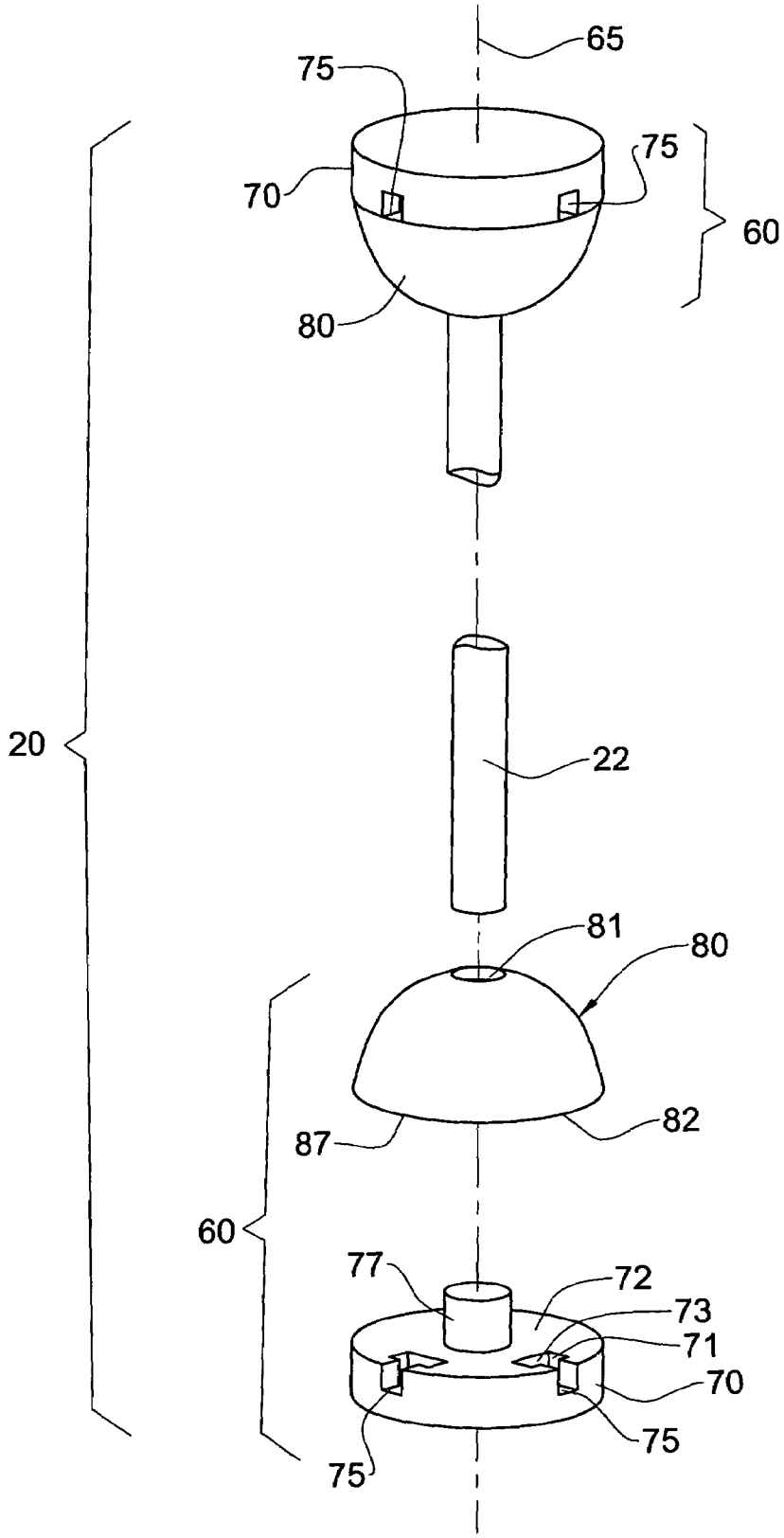
FIG. 3 is a fragmented partially exploded view of a corner module of FIG. 1.

Referring particularly to FIG. 3, each corner module 20 comprises a vertical strut or upright 22, typically of uniform cross-section and of a suitable height correlated to the intended height of the enclosure 10. The upright 22 may be solid or hollow and may optionally comprise internal or external stiffening elements, and may further comprise any suitable cross-sectional shape, for example circular as illustrated in FIG. 3, or alternatively polygonal including triangular, square and rectangular for example, oval and so on. The upright 22 is preferably made from a plastic material, but may also be made from any other suitable material including for example wood, metal, composites and so on. A connector assembly 60 is joined to each longitudinal end of said upright 22. Each connector assembly 60 is made from two clamping parts 70, 80 which mutually engage to clamp therebetween the ends of cross-members 30, as will be further described hereinbelow. Outer clamping part 70 is generally disc-shaped and comprises on its cylindrical periphery two T-shaped slots 75 spaced at 90° from one another with respect to the axis 65 of the corner module 20. Each T-shaped slot 75 comprises a neck portion 71 at the cylindrical periphery of clamping part 70 and an enlarged portion 73 radially displaced from the neck portion towards the axis 65, and extends uniformly from annular surface 72 to about half the thickness of part 70 in the axial direction. A male connector, typically in the form of threaded central hub 77 connects with a female connector, in this case a complementary-threaded central bore 87 of the inner clamping part 80, such that facing surfaces 72, 82 of the parts 70, 80, respectively, abut. Alternatively, any other suitable connection can be provided for reversibly connecting the two parts 70, 80, such as for example snap-fit, bayonet fit, and so on, and alternatively a male connector may be comprised in part 80, an a female connector in the part 70. Clamping parts 70, 80 comprise a smooth outer surface, which advantageously minimize the risk of an infant unscrewing or otherwise disengaging these parts one from the other, which would otherwise risk the enclosure becoming disassembled.

As will become clearer hereinbelow, the clamping parts 80 are designed to rotate freely with respect to the upright 22, and also to axially translate with respect to upright 22 at least to a predetermined limit. Thus, the opposed ends of the upright 22 are received one each in bores 81 provided in the parts 80, as illustrated in FIG. 3, such as to provide a loose fit, for example, or alternatively a suitable mechanism is provided to permit the aforesaid freedom of movement while still maintaining the two parts 80 and the upright 22 in engagement. In other embodiments, the parts 70, 80 may be of any other suitable plan shape when viewed along axis 65, for example polygonal.

Figure 4:
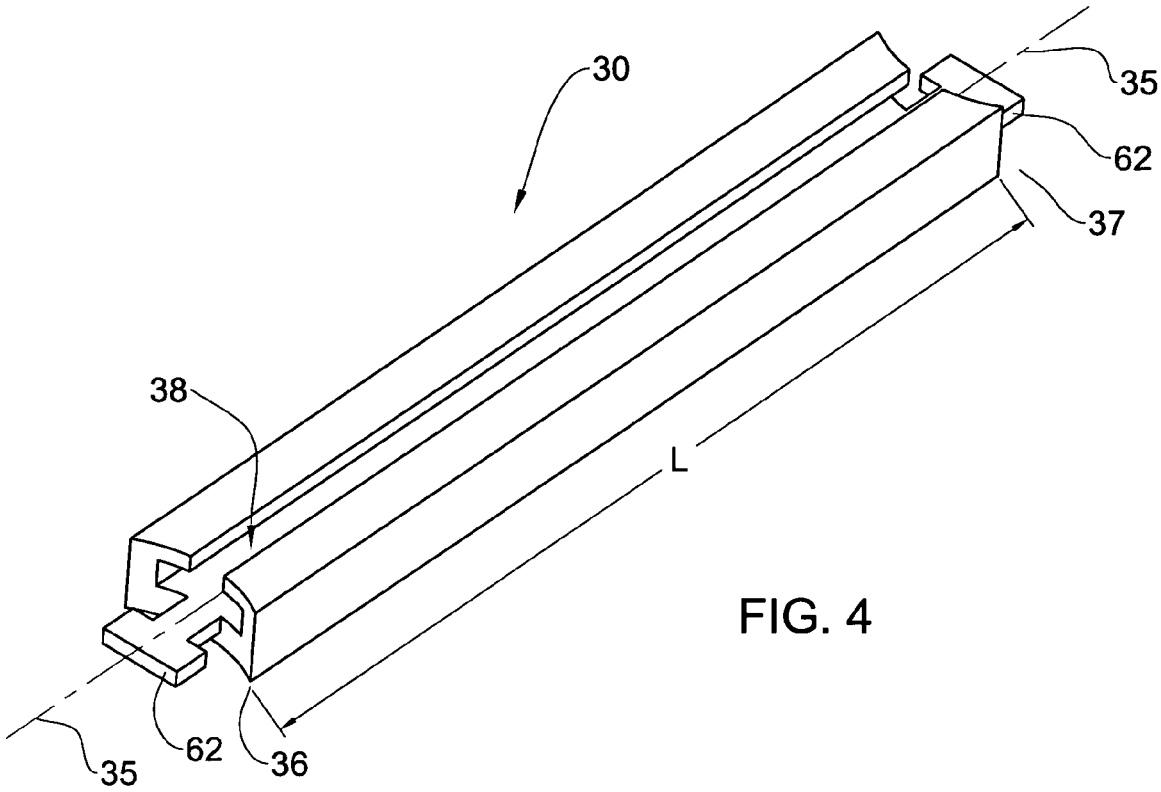
FIG. 4 is a perspective view of a cross-member of FIG. 1.
Figure 5A:
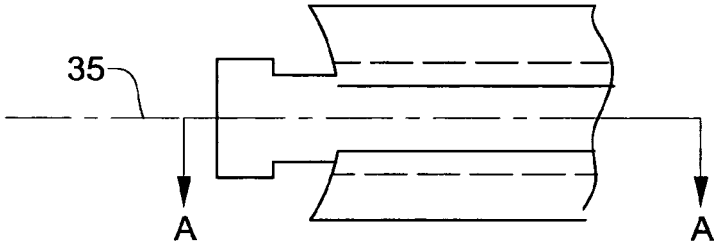
FIG. 5*a* is a plan fragmented view of a longitudinal end of the cross-member of FIG. 4.
Figure 5B:
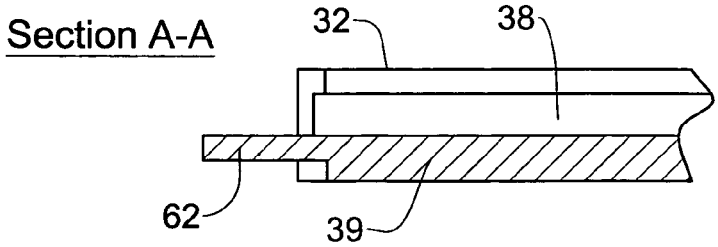
FIG. 5*b* is a cross-section view of the cross-member of FIG. 5*a* taken along A-A.
Figure 6A:
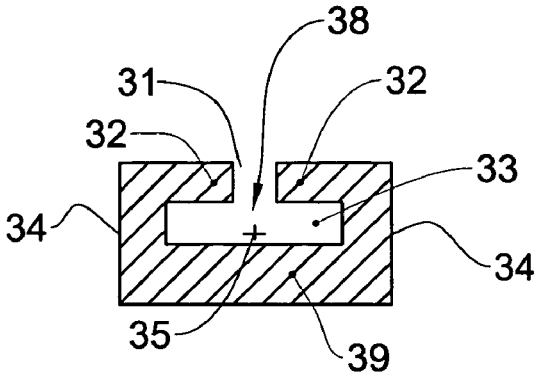
FIGS. 6*a* to 6*g* illustrate in transverse cross-section view exemplary profiles for the channel of the cross-member of FIG. 4.
Figure 6B:
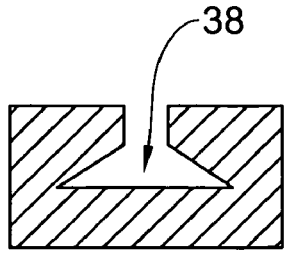
Figure 6C:
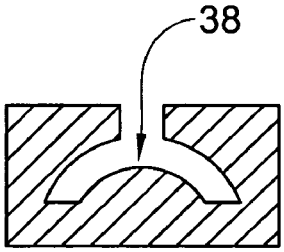
Figure 6D:
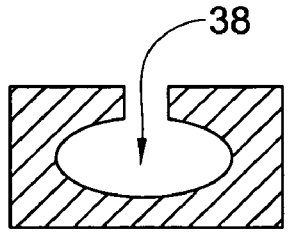
Figure 6E:
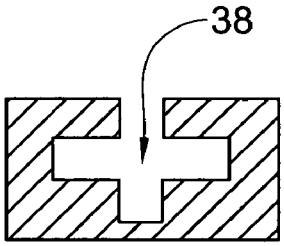

Referring now to FIGS. 4, 5*a*, 5*b*, cross-members 30 are typically rectilinear components typically having a uniform transverse cross-section profile. In particular, each cross-member 30 comprises a channel 38 that is adapted for securing therein the longitudinal ends of the bars 40, as will be further described herein. As illustrated in FIG. 6*a*, the channel 38 typically comprises a T-profile, having a neck portion 31 at inner-facing wall 32 of cross-member 30 and an enlarged portion 33 displaced from the neck portion towards the longitudinal axis 35, and extends uniformly from one longitudinal end 36 to the other longitudinal end 37 of the cross-member 30 in the axial direction. The T-profile is formed by the space enclosed between an external facing wall 39, side walls 34 and inner facing wall 32, which is formed as a pair of parallel spaced strips. While the transverse cross-sectional profile of the cross-member 30 is typically rectangular, it may be of any suitable shape, including but not restricted to for example circular, polygonal, oval and so on.

The cross-member 30 is typically formed as an integral member, for example by extrusion, molding, or any other suitable manner, and is typically made from a suitable plastic material, though may be made from any suitable material including but not limited to a metal, e.g., aluminium, or wood, or a composite material. Alternatively, the cross-member 30 may be made by suitably joining said walls 32, 34, 39 using any suitable means, for example bonding.

Figure 6F:
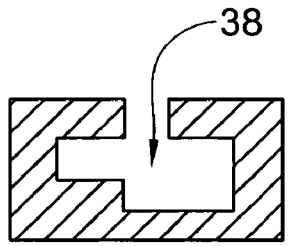
Figure 6G:
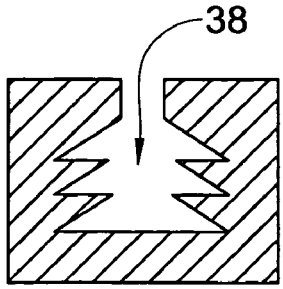

Many alternative cross-sectional profiles for the channel 38 are possible, for example, and as illustrated in FIGS. 6*b* to 6*g*, the enlarged portion 33 of channel 38 may be other than T-shaped, for example trapezoidal (FIG. 6*b*), circular (FIG. 6*d*), cross-shaped (FIG. 6*e*), crescent-shaped (FIG. 6*c*), double-serrated (FIG. 6*g*) and so on. The enlarged portion 33 is not necessarily symmetrical, but as illustrated in FIG. 6*f*, for example, the portion 33 may be asymmetrical such that the ends of bars 40 may only be inserted in a particular direction, for example, which may be useful in some embodiments of the bars 40, as will be further disclosed herein.

Figure 7A:
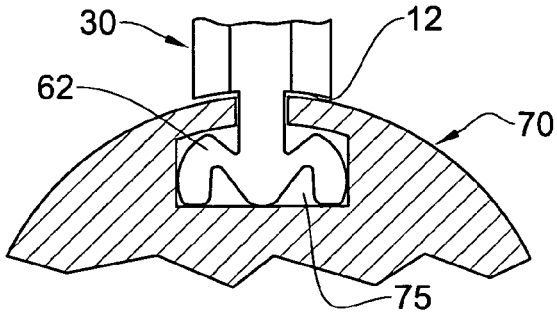
FIGS. 7*a* and 7*b* illustrate in fragmented plan view exemplary configurations for the engagement arrangement between the cross-member and corner module of FIG. 1.
Figure 7B:
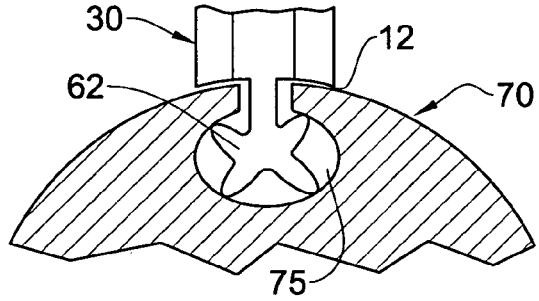

Referring again to FIGS. 4, 5*a*, 5*b*, each longitudinal end 36, 37 of the cross-member 30 comprises a cylindrical surface 12, complementary to the external cylindrical periphery of clamping part 70 of the connector assembly 60. The axis of revolution of the cylindrical surfaces 12 is orthogonal to the walls 32, 39, and substantially co-axial with axis 65 when the cross-member 30 is properly engaged with the corresponding corner module 20. Extending outwardly in the axial direction from each said end 36, 37 is a T-shaped engagement member 62, having a shape substantially complementary to said T-shaped slot 75 of the connector assembly 60 for engagement therewith when the cross-member 30 is properly engaged with the corresponding corner module 20. The engagement member 62 is typically formed as an extension of said wall 39, typically half the thickness thereof as best seen in FIG. 5*b*. Thus, conveniently, the cross-member 30 may be formed as a constant-section workpiece, for example by extrusion, and the engagement members 62, together with said cylindrical surfaces 12, can be formed at the ends of the workpiece by machining or by employing any other suitable material removal means to, the said ends of the workpiece. Of course, the actual form of the engagement member 62 will depend on, and always be substantially complementary to, the form of the slots 75 of the corner modules 20. Thus, for example, if the corner module 20 comprises slots 75 similar to those shown in FIGS. 6*a* to 6*g* for channel 38, the engagement members 62 will have a suitable complementary form to engagingly fit therein. In this context, by "complementary" it is meant that the engagement member 62 comprises a geometry such as to enable it to be retained within the slot 75 when the parts 70 and 80 are mutually engaged. Thus, and referring to FIGS. 7*a* and 7*b* for example, it is possible for the engagement member 75 to be M-shaped or X-shaped, respectively, for engagement with a T-shaped or circular-shaped slot, respectively, as illustrated therein.

In other embodiments (not illustrated herein), the inner facing clamping members 80 may be adapted for receiving therein suitable engagement elements correspondingly formed at the longitudinal ends of the cross-members 30, and the outer facing clamping elements 70 simply lock the engagement elements in place. Accordingly, the clamping parts 80 may be rigidly connected to upright 22.

Figure 8:
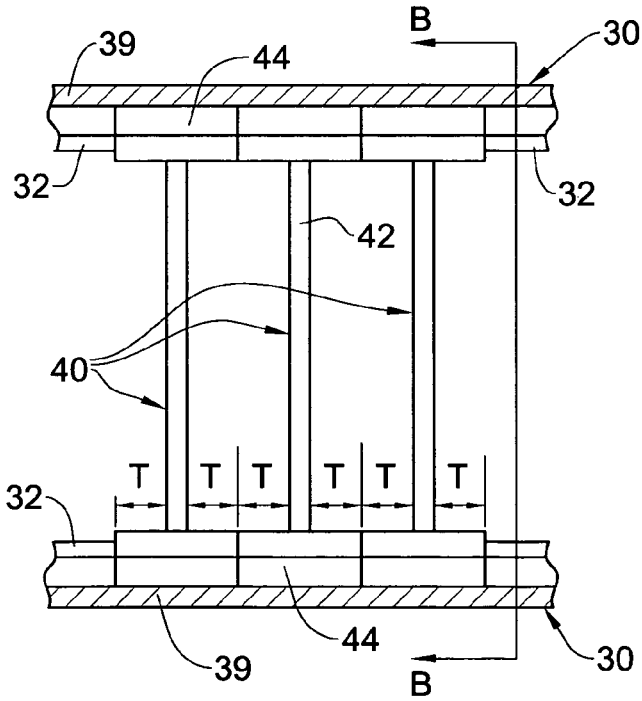
FIG. 8 illustrates in partial fragmented and cross-sectional view a plurality of bars engaged in cross-members.
Figure 9:
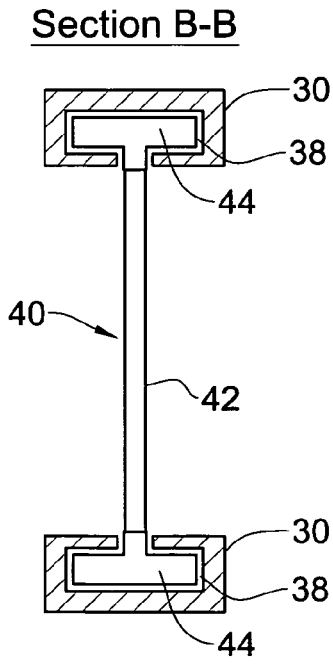
FIG. 9 illustrates the embodiment of FIG. 8 along B-B.

Each pair of cross-members 30 comprises a set of bars 40 engaged therewith, as illustrated in FIGS. 8 and 9. In the illustrated embodiment, the bars 40 are substantially H-shaped and identical one to another, and each comprise an upright strut 42 flanked at each longitudinal end with a spacer element 44. The spacer elements 44 comprise a cross-sectional profile that is substantially complementary to the profile of the channel 38 of the cross-members 30, enabling each spacer element 44 to be slidingly received and engaged therein. Thus, the spacer elements 44 are typically of uniform cross-section and extend orthogonally with respect to the upright struts 42 to a length T, wherein T is half of the spacing required between struts 42, as illustrated in FIG. 8. The spacing between bars, 2*T, is typically such as to prevent an infant from trapping his neck between adjacent bars, and is typically set by national standards. The length L (FIG. 4) of the cross-members 30, between the cylindrical surfaces 12, is such as to snugly accommodate in each channel 38 an integral number of spacer elements 44, corresponding to an integral number of bars 40.

Figure 10:
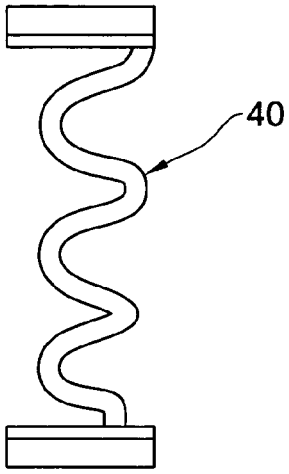
FIG. 10 illustrates a sinusoidal configuration for the bar of FIG. 1.
Figure 11A:
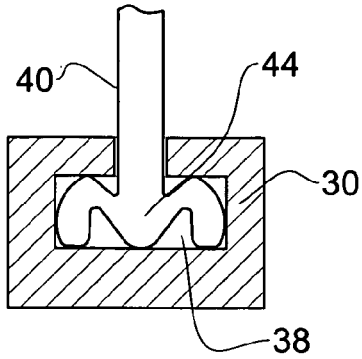
FIG. 11*a* and 11*b* illustrate in fragmented plan view exemplary configurations for the engagement arrangement between the bars and cross-member of FIG. 9.
Figure 11B:
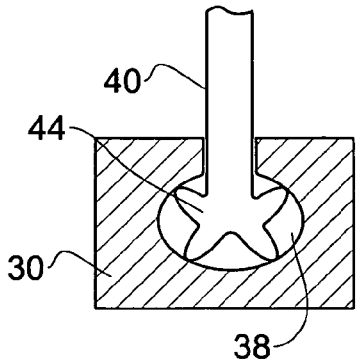

Typically, the ends of strut 42 are each joined orthogonally to the corresponding spacer element 44 at substantially the longitudinal center thereof. The strut 42 itself is typically rectilinear and of constant section, as illustrated in FIGS. 8 and 9, or alternatively in any other suitable shape, for example a wave or a sinusoidal form as illustrated in FIG. 10, zig-zag, in the shape of a flower, tree, teddy bears, toy, clown, and so on. The strut 42 may be solid, or hollow and may optionally comprise internal or external stiffening elements, and may further comprise any suitable cross-sectional shape, for example circular, or alternatively polygonal including triangular, square and rectangular for example, oval and so on. Similarly, the spacer elements 44 are typically rectilinear and of constant section, and may be solid, or hollow and may optionally comprise internal or external stiffening elements, and may further comprise any suitable cross-sectional shape that allows the spacers to be slidingly engaged in the said channels 38. Though the spacer elements 44 are typically complementarily-shaped with respect to the channels 38, it is possible for the spacer elements to have any suitable profile such as to be retained within the channel 38. Thus, and referring to FIGS. 11*a* and 11*b* for example, it is possible for the profile of the spacer elements 44 to be M-shaped or X-shaped, respectively, for engagement with a T-shaped or circular-shaped slot, respectively, as illustrated therein.

Thus, by being retained in channel 38, the bars 40 lock together the pair of parallel cross-members in a direction parallel to the longitudinal axis of the bars 40. Locking of the bars 40 with respect to the channels 38 is via the corner modules 20.

The strut 42 and the spacer members 44 are preferably made from a plastic material, but may also be made from any other suitable material including for example wood, metal, composites and so on. Preferably, the bars 40 are made as integral components, though alternatively they may be formed as separate components, suitably joined to one another.

Figure 12:
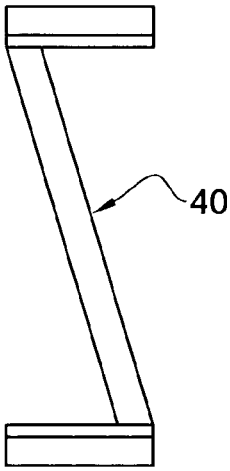
FIG. 12 illustrates a Z-form configuration for the bar of FIG. 1.
Figure 13:
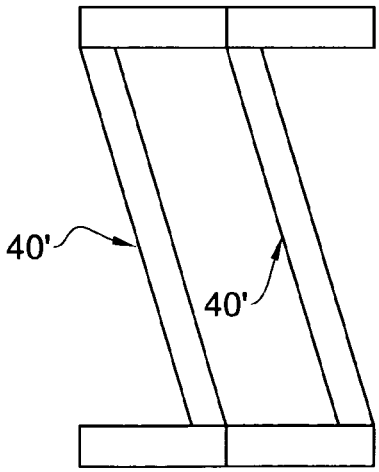
FIG. 13 illustrates a plurality of bars of FIG. 12 properly aligned.
Figure 14:
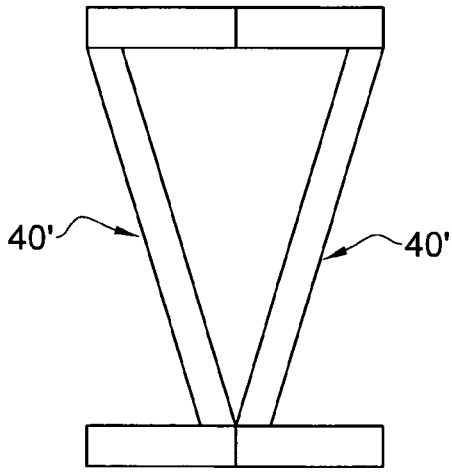
FIG. 14 illustrates a plurality of bars of FIG. 12 improperly aligned.

Alternatively, and as illustrated in FIG. 12, the bars 40 may be Z-shaped rather than H-shaped illustrated in FIGS. 8 and 9. In the case of the embodiment of the bars, illustrated in FIG. 12, designated 40', the channel 38 of each corresponding cross-members 30 is preferably non-symmetrical, for example as illustrated in FIG. 6*f*, to ensure that all the Z-shaped bars 40' are arranged serially in the same orientation, as illustrated in FIG. 13, thus avoiding a wide triangular opening from being formed if two such bars 40' are placed in series in opposite orientation illustrated in FIG. 14.

Figure 15:
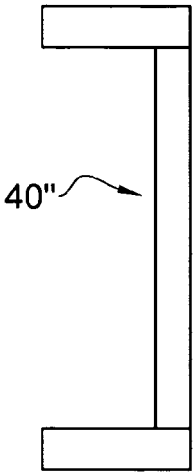
FIG. 15 illustrates a U-form configuration for the bar of FIG. 1.
Figure 16:
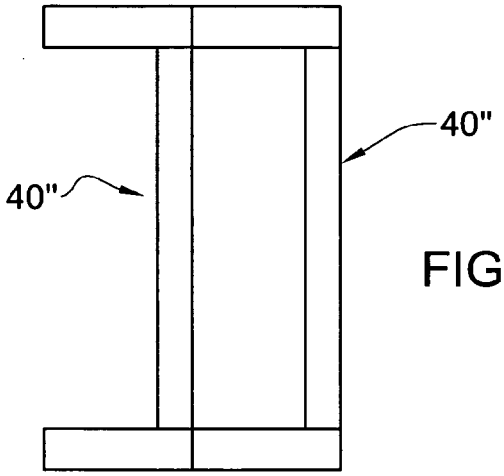
FIG. 16 illustrates a plurality of bars of FIG. 15 properly aligned.
Figure 17:
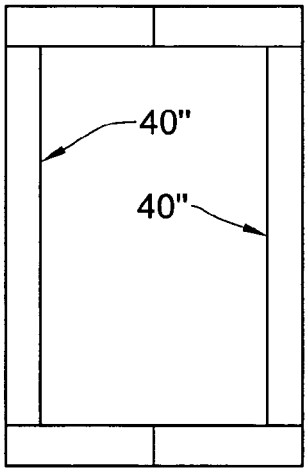
FIG. 17 illustrates a plurality of bars of FIG. 15 improperly aligned.
Figure 18:
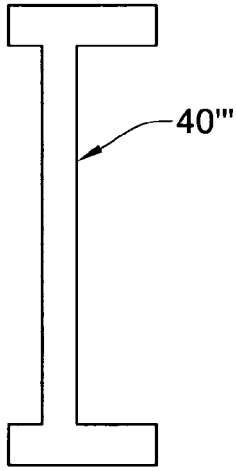
FIG. 18 illustrates an asymmetric H-form configuration for the bar of FIG. 1.
Figure 19:
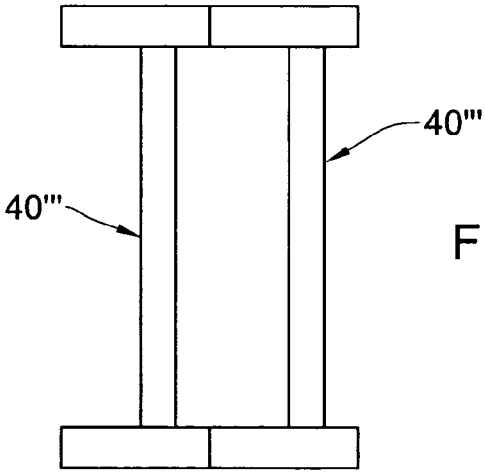
FIG. 19 illustrates a plurality of bars of FIG. 18 properly aligned.
Figure 20:
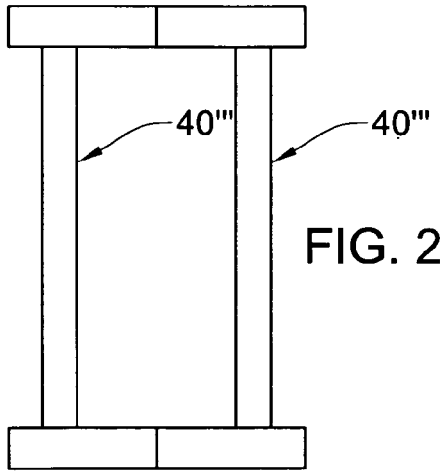
FIG. 20 illustrates a plurality of bars of FIG. 18 improperly aligned.

Alternatively, and as illustrated in FIG. 15 the bars, designated herein as 40" may be U-shaped, or asymmetrical H-shaped as illustrated in FIG. 18 and designated 40'". In the case of the embodiments illustrated in FIGS. 15 and 18, the channel 38 is preferably non-symmetrical, for example as illustrated in FIG. 6*f*, to ensure that all the U-shaped bars 40" or asymmetrical H-shaped bars 40'" are arranged serially in the same orientation (FIGS. 16, 19 respectively), thus avoiding a wider than desired rectangular opening from being formed if two such bars are placed in each case in series in opposite orientation illustrated in FIG. 17 and FIG. 20, respectively.

Optionally, auxiliary spacer elements (not shown) may be provided, having the same cross-sectional profile as said spacer elements 44, to further control the dimension of the spacings between adjacent struts 42. Further optionally the spacer elements 44 used in conjunction with said auxiliary spacer elements may have the longitudinal width of the struts 42, or greater if desired.

Further optionally, the spacer elements 44 may be adapted for engaging with longitudinally disposed adjacent said spacer elements 44, particularly when engaged in the channel 38. For this purpose, the longitudinal ends of the spacer elements 44 may comprise, for example, male or female engagement parts which engage with corresponding female or male engagement parts of adjacent spacer elements 44.

Figure 21:
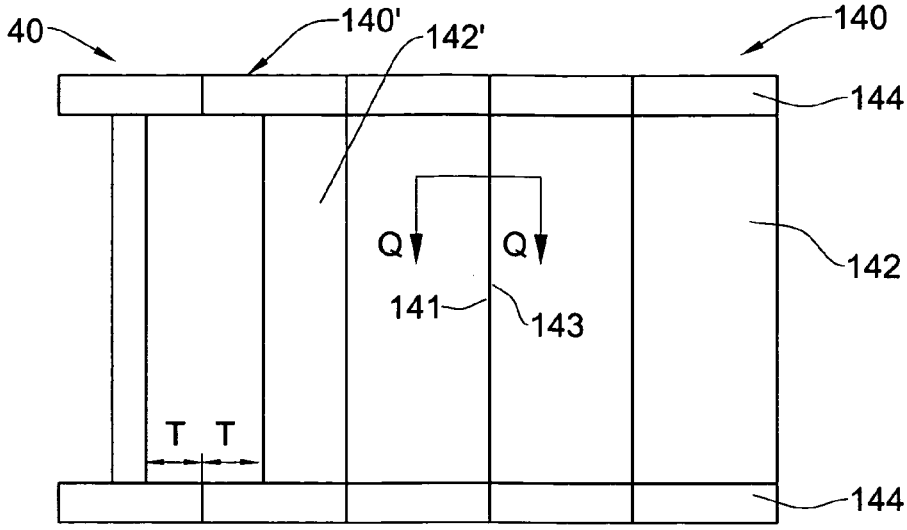
FIG. 21 illustrates a plurality of panel form configurations for the bar of FIG. 1.
Figure 22:
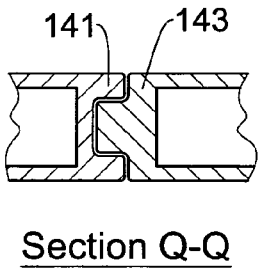
FIG. 22 illustrates in partial cross-sectional view an engagement detail of adjacent panel form configurations of FIG. 21, taken along Q-Q.

Optionally, and referring to FIG. 21, at least some of the bars 140 may comprise panel elements 142, rather than narrower struts, and having spacer elements 144 at the longitudinal extremities thereof to allow engagement with an upper and lower cross-members 30 (not shown in this figure) in a similar manner to the bars 40, mutatis mutandis. As illustrated in FIG. 21, the panel elements 142 have a substantially solid appearance (although thy may be hollow, optionally) may have a transverse extent substantially correlated to that of the spacer elements, so that when such bars 140 are engaged adjacently with respect to two cross-members 30, there are effectively no voids between them, and thus has the appearance of a continuous solid panel. Advantageously, the facing transverse edges 141, 143 of adjacent panel elements may be contoured such as to enable mutual engagement between adjacent bars 140, FIG. 22. Thus, the bars comprise struts that are in the form of slats, spanning the length of the spacer elements. In such a case, such bars are inserted between a pair of parallel spaced cross-members to provide a substantially solid panel, which may be used typically in two opposed ends of a crib-like enclosure 10.

Optionally, some bars 140' may comprise a panel element 142' that only extends partially in the transverse direction with respect to the spacing elements 144, providing, when a regular bar 40 is adjacent thereto, a void of width 2*T, substantially similar to that between two regular bars 40.

Figure 25:
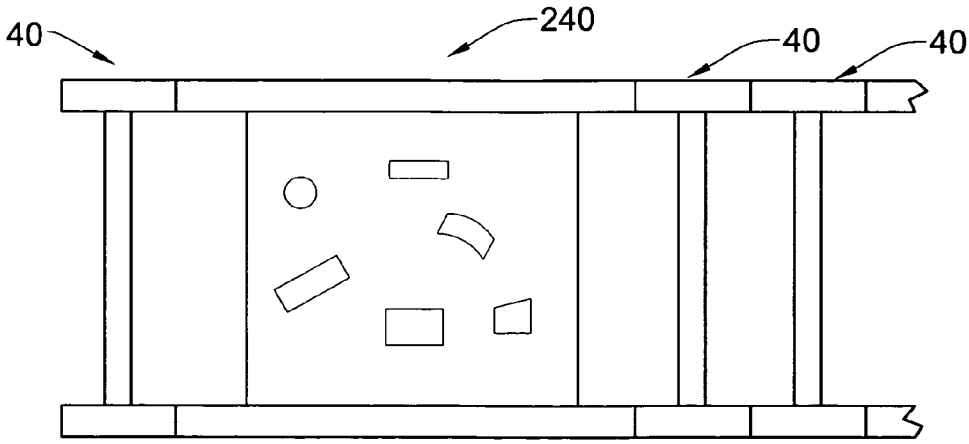
FIG. 25 illustrates an entertainment panel adapted for engagement with cross-members of FIG. 1.

Further optionally, an entertainment panel 240 having entertainment elements 241, such as bells, wheels, buttons, and so on, for example, may be provided, having the width of one or an integral number of said paneled bars 140 or 140', for example as illustrated in FIG. 25. Such an entertainment panel 240 comprises a pair of spacer members 244 which are adapted for engagement with the channels 38 of the cross-members 30 and thus may be engaged with respect thereto in a similar manner to that described for the regular bars 40. Thus, the entertainment panel 240 may replace one or a number of said bars 40 in an infant enclosure, at the same time providing structural support in a similar manner to the bars 40 themselves.

Figure 23:
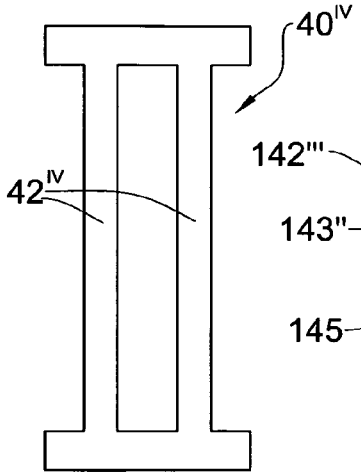
FIG. 23 illustrates a double strut comprising configuration for the bar of FIG. 1.
Figure 24:
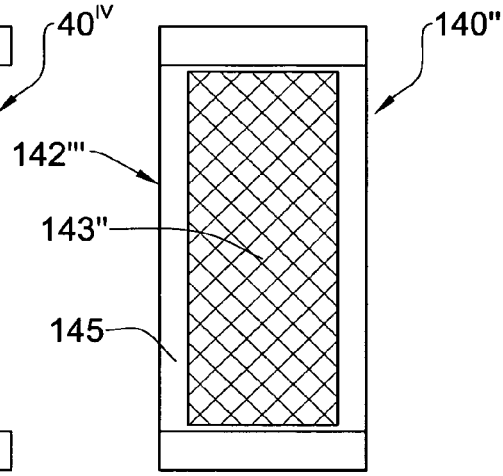
FIG. 24 illustrates a net or mesh configuration for the bar of FIG. 1.

Further optionally, and referring to FIG. 24, at least some of the bars 140" may comprise netted elements 142", and may be similar to the panel elements 140 or 140' as described above, mutatis mutandis, but rather than being of solid appearance, comprise a mesh or net 143", which may be optionally supported by means of frame 145". The netted bars 140", as well as the paneled bars 140 or 140" may optionally have the transverse extent of two or more spacer elements used with regular bars 40. Furthermore, optionally, it is clear that at least some of the bars $\mathbf{40}^{iv}$ may have two or more struts $\mathbf{42}^{iv}$ on spacer elements $\mathbf{44}^{iv}$, rather than a single strut, and the spacer elements $\mathbf{44}^{iv}$ may be of any desirable length, as illustrated in FIG. 23.

In other embodiments, it is possible to have any combination of different types of bars 40, including bars 140, 140' and 140' as desired, so long as the spacer elements 44 thereof are suitable for the channels 38 of the cross-members 30 with respect to which the bars 40 are to be assembled, and the spacer elements are typically of equal length with respect to the channels, or at least of lengths that are multiples of one another. For example, one side of the enclosure may comprise a series of regular H-shaped bars which may be interspersed with bars in the form of teddy bears or flowers, another side of the enclosure may be assembled from paneled bars 140 to form a solid wall, and another side with netted bars 140" to provide a netted appearance, according to the user's choice, providing infinite combination and permutation possibilities.

In other embodiments, not illustrated, the cross-members 30 may be curved, for example, to provide different shapes of enclosure 10, and the spacer elements 44 are corresponding shaped to be engaged therein.

Figure 26:
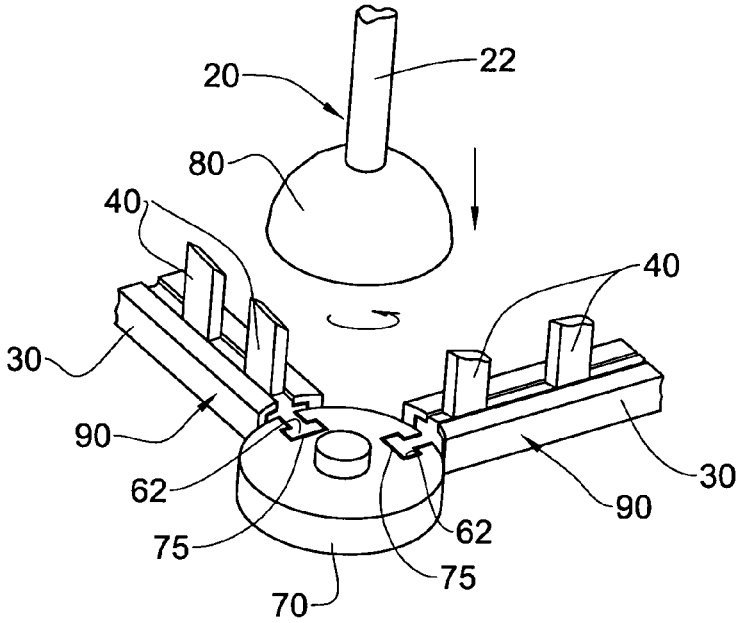
FIG. 26 illustrates in partial isometric view a corner of the embodiment of FIG. 2 being assembled.

Assembly of the infant enclosure 10 in rectangular configuration illustrated in FIG. 2 may be carried out as follows, referring in particular to FIG. 26. First, four panel assemblies 90 are assembled, wherein for each panel assembly 90, a plurality of bars 40 are engaged with respect to a pair of parallel vertically spaced cross-members 30 by sliding the spacer elements 44 of each bar 40 into the corresponding cross-members 30 via the corresponding channels 38, such as to substantially fill the channels 38. In FIG. 26, only the bottom parts of two adjacent panels 90 are illustrated together with a part of the corresponding corner module 20. The panel assemblies 90 may be of substantially equal longitudinal lengths to provide a square enclosure, or alternatively, opposed pairs of panel assemblies 90 may be of different lengths to provide a rectangular enclosure, and the longitudinal length of each panel assembly 90 is determined by the length of the cross-members 30 used in connection therewith. Then, the four panel assemblies 90 thus formed are connected in square or rectangular configuration by connecting each pair of adjacent longitudinal ends to a corner module 20 as follows.

Figure 2:
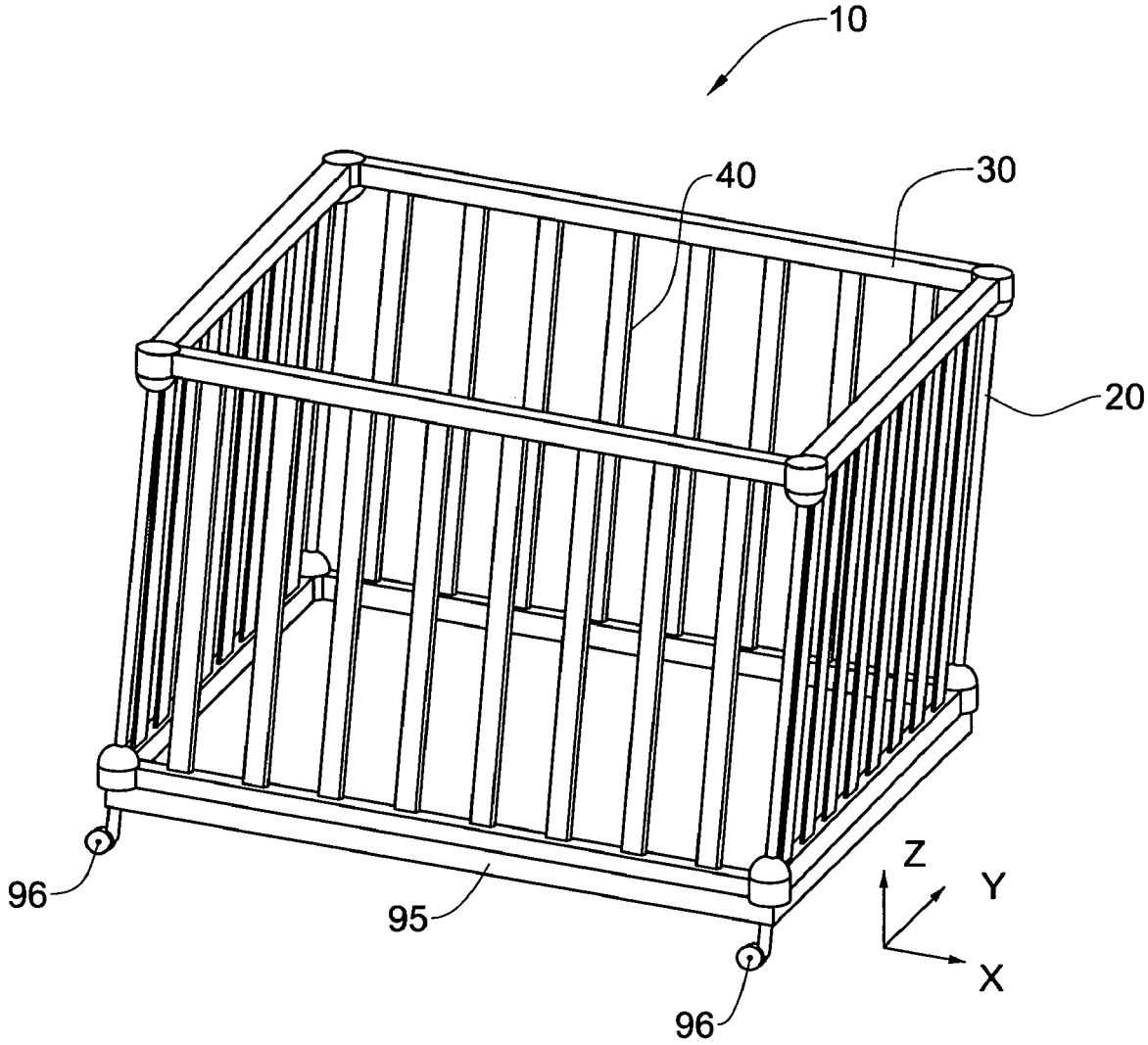
FIG. 2 is a perspective view of an infant enclosure according to a first aspect of the invention assembled from a kit comprising a plurality of parts illustrated in FIG. 1.

Thus, referring to FIGS. 2 and 21, at each corner of the infant enclosure 10, a corner module 20 is provided, and the clamping parts 70 at opposite ends of each corner module 20 are disengaged therefrom. The engagement members 62 at the corresponding ends of the upper and lower cross-members 30 of each pair of adjacent panels 90 are engaged in the corresponding slots 75 of these parts 70. Thus, the two engagement members 62 of the upper adjacent cross-members 30 are engaged with respect to an upper said part 70 in orthogonal relationship, and the two engagement members 62 of the lower adjacent cross-members 30 are engaged with respect to a lower said part 70 also in orthogonal relationship. Then, the remainder of the corner module 20 for these adjacent panel assemblies 90, i.e., the upright 22 and the two clamping parts 80 one at either end thereof, are brought into alignment with the parts 70 which are now engaged with the two panel assemblies 90. The panel assemblies 90 are now at 90° to one another, and parts 80 are engaged with corresponding parts 70, as described above, to lock the engagement member 62 therein. The parts 80 allow the strut 22 to axially translate and to rotate within the same, and the bore 81 for receiving the strut 22 is typically smaller than the central bore 87. Optionally, it is possibly to do away with the strut 22 altogether, and to assemble the panel assembles 90 using only the clamping parts 70, 80 at the top and bottom thereof.

It should be noted that the actual size of the enclosure 10 is determined in the first place by the dimensions of the cross-members 30. The kit 50 may optionally comprise different-sized cross-members 30, or alternatively the consumer or user may choose the sizes of the cross-members 30, to enable the size of the enclosure to be changed accordingly, or the user may chose a particular size when ordering or purchasing the kit. Thus, for example, if the enclosure is first used as a crib for an infant, if it is decided subsequently to enlarge the enclosure, the enclosure is partially or fully disassembled, and the required number of cross-members 30 replaced with longer ones. The used bars 40 may be re-used, and additional ones added to fill up the extra room provided by the longer cross-members 30. The longer panel assemblies 90 thus assembled may then be connected together to form a larger enclosure. Further alternatively, the bars 40 may also be replaced by longer bars, to provide an enclosure of greater height. For this purpose, the strut 22 may also be replaced with a correspondingly longer strut, or indeed the complete corner modules 20 may be replaced with longer corner modules. Similar considerations apply, mutatis mutandis, if it is wished to contract the side of the enclosure 10.

Disassembly of the enclosure 10 is basically the reverse of the assembly process. Essentially, at each corner of the enclosure 10, the clamping parts 80 are disengaged from the clamping parts 70, and the subassembly comprising upright 22 and two clamping parts 80 is removed, to be further disassembled into the individual components is desired. Then, the panel assemblies 90 are disengaged from the clamping parts 70, whereupon each panel assembly 90 may be disassembled by removing the bars 40 from the two cross-members 30 thereof.

Other ways of assembling and disassembling the enclosure 10 are also possible. A number of optional mounting options are available for the enclosure, typically depending on the intended use thereof. For example, the enclosure 10 may be simply rested on the floor of a dwelling or another hard surface such as a patio or street, for example, and the portion of floor enclosed by the enclosure becomes the base of the enclosure. The enclosure may be stabilized by using bags of sand or the like, and securing the bags thereto. Additionally or alternatively, where appropriate, suitable suction pads may be provided, for example joined to the bottom clamping parts 70, to secure the enclosure to a smooth surface such as floor tiles or linoleum. Additionally or alternatively, where appropriate, suitable hook and loop arrangements such as Velcro pads may be provided, for example joined to the bottom clamping parts 70. For example, hook pads of such an arrangement may be provide, allowing the enclosure to be secured directly to a carpet, or to aligned loop pads previously bonded to the floor. The enclosure may then be used as a playpen or play den, and optionally, a mat may be provided within the enclosure 10 for infant comfort. Alternatively, a mattress may be provided in the enclosure 10, which then acts as a crib.

Herein, the mattress may be a regular mattress, comprising a cushioning material such as foam, and/or a spring arrangement, or may comprise an inflatable mattress, inflatable with air, water or any other suitable fluid.

Alternatively, the enclosure 10 may be mounted onto a base 95 illustrated in FIG. 2, by screwing or clamping the base 95 to the lower cross-members 30 and/or parts 70, for use as a play pen or as a play den. Optionally, a mat may be provided within the enclosure 10 for infant comfort or a mattress may be inserted into the enclosure 10, which can then be used as a crib. Further optionally, wheels 96, which may be fixed direction wheels or caster wheels, for example, may be provided for providing mobility to the enclosure 10.

Figure 27:
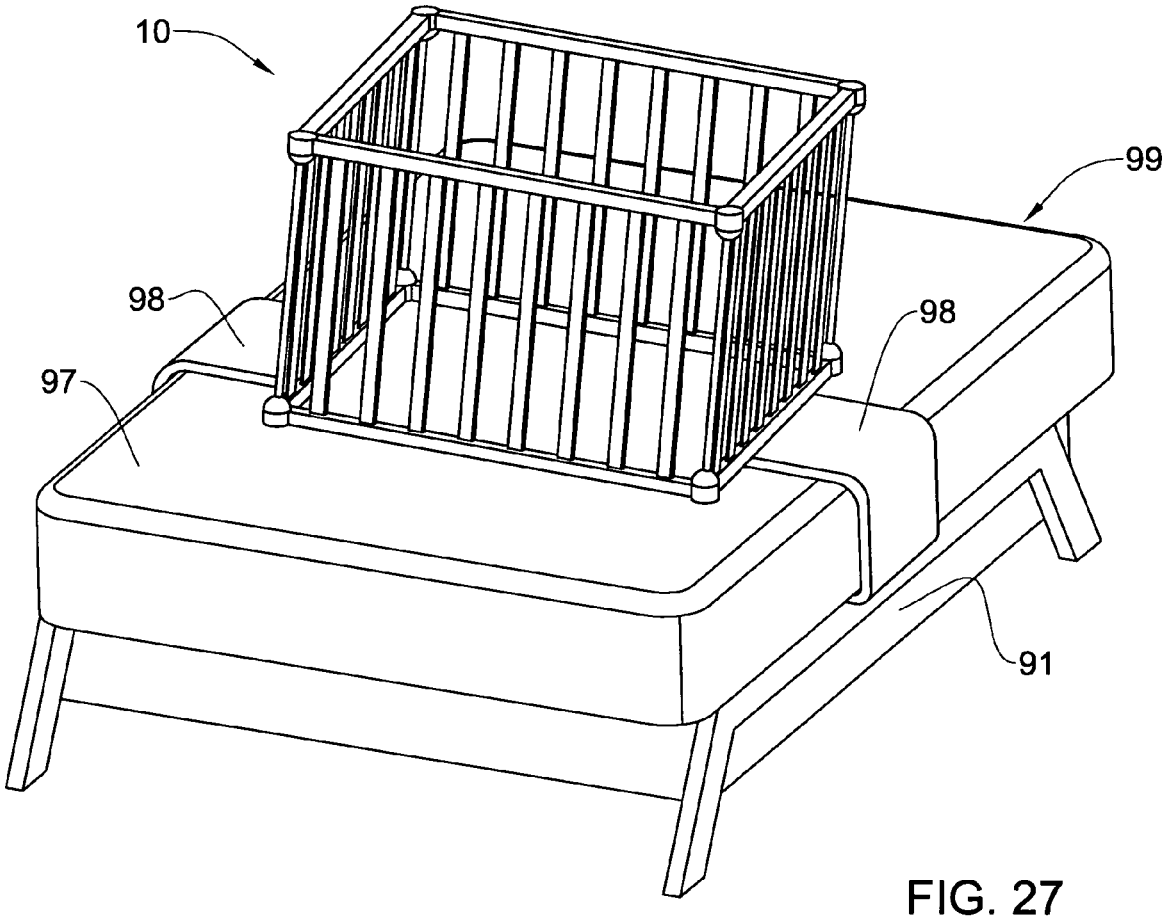
FIG. 27 illustrates in isometric view an infant enclosure mounted onto a bed.

Alternatively, and as illustrated in FIG. 27, the enclosure may be mounted onto a bed 99 by means of a belt or strap arrangement 98, which is suitably connected to the enclosure 10, typically the lower part thereof, and loops around the mattress 97 of the bed 99. Alternatively, a pair of resilient hook elements, attached to the enclosure 10, may grasp the sides of the mattress.

Figure 28:
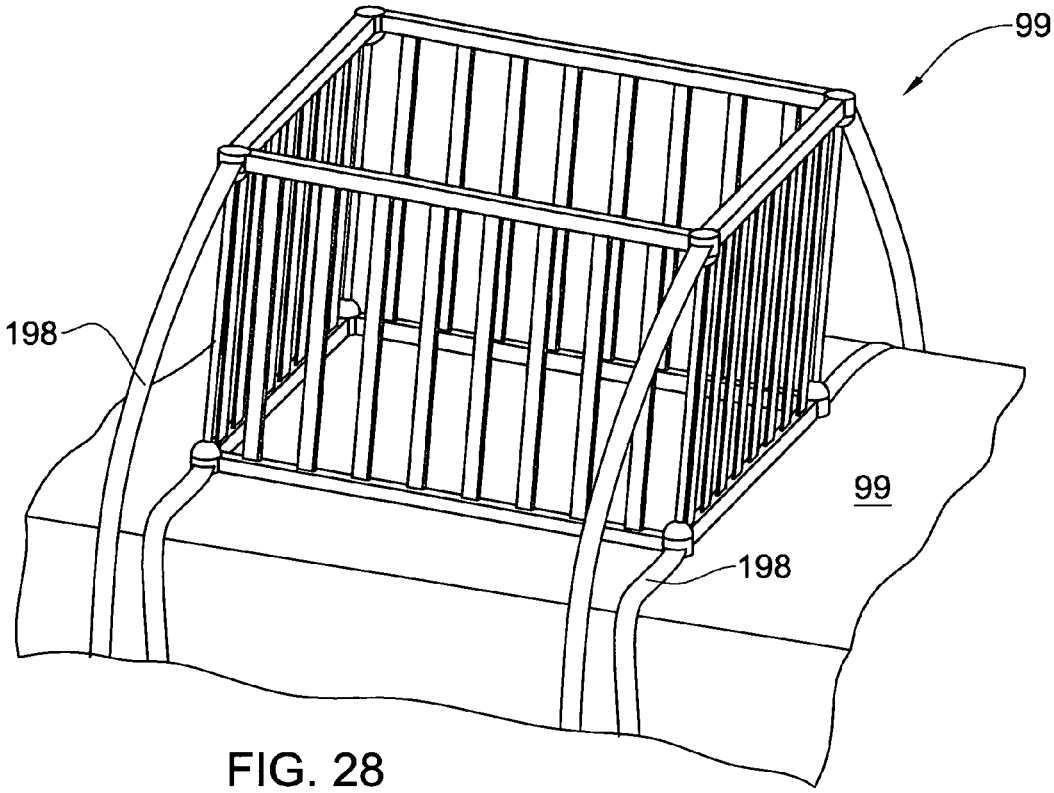
FIG. 28 illustrates in isometric view an alternative configuration for mounting an infant enclosure onto a bed.
Figure 29:
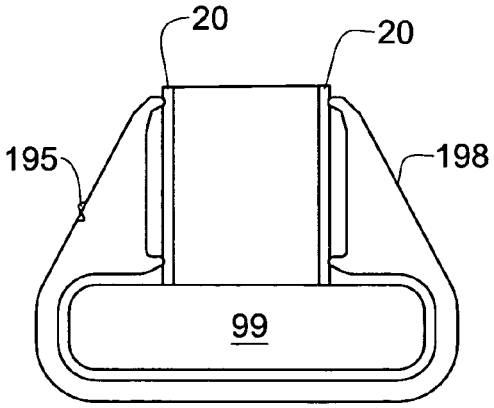
FIG. 29 illustrates in front view the belt arrangement used in the embodiment of FIG. 28.
Figure 30:
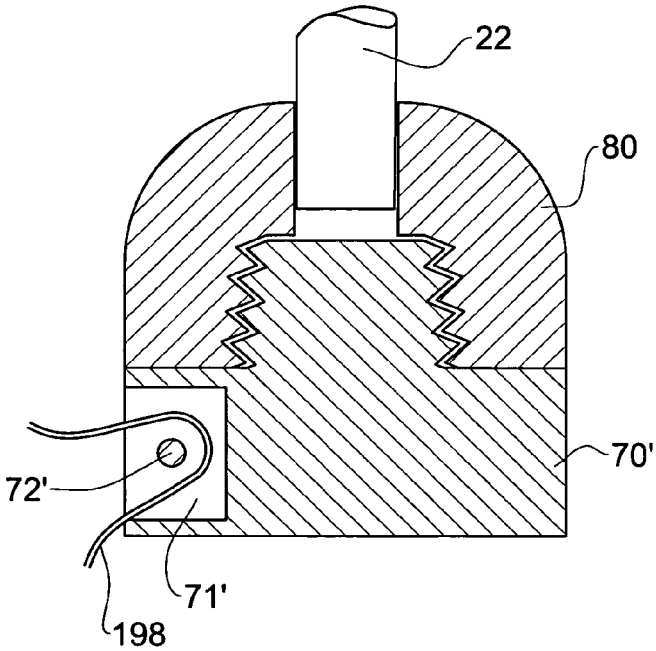
FIG. 30 illustrates in cross-sectional view a corner module of the embodiment of FIGS. 28 and 29.

Alternatively, and as illustrated in FIGS. 28 to 30, the enclosure may be mounted onto a bed 99 by means of a belt or strap arrangement 198, which is suitably connected to the enclosure 10 via the corner modules 30. For this purpose, and referring particularly to FIG. 30, the clamping part 70 may be modified, shown as 70' in this figure, to include a recess 71' comprising a pin 72', enabling the strap arrangement 198 to be secured to the pin 72' and/or to be looped around the pin. As illustrated in the FIG. 29 particularly, a length of strap of the strap arrangement 198 may be looped around the pins in an upper and a lower clamp part 70' of a first corner module 20, around the bottom part of the mattress, looped around the pins in an upper and a lower clamp part 70' of a second corner module 20 transversely opposed to the first corner module, around the bottom part of the mattress a second time and back to the first corner module. The strap can then be tightened using any suitable tightening mechanism 195, which are known per se.

The belt or strap arrangement may be closed using any suitable closure means, such as for example a buckle, snap fit fasteners, Velcro fasteners, and so on. The area of the mattress 97 enclosed by the enclosure 10 becomes the mattress of the enclosure 10 which now acts as a crib. Alternatively the mattress of the bed 99 is removed, and the enclosure 10 may be mounted onto the bed box 91 via strap arrangement 98, in which case the enclosure can act as a playpen, for example; a similar effect may be obtained by strapping the enclosure 10 onto any raised platform, including for example a table, desk, sofa, and so on. A suitable mattress or mat may be inserted into the enclosure for infant comfort.

Figure 34:
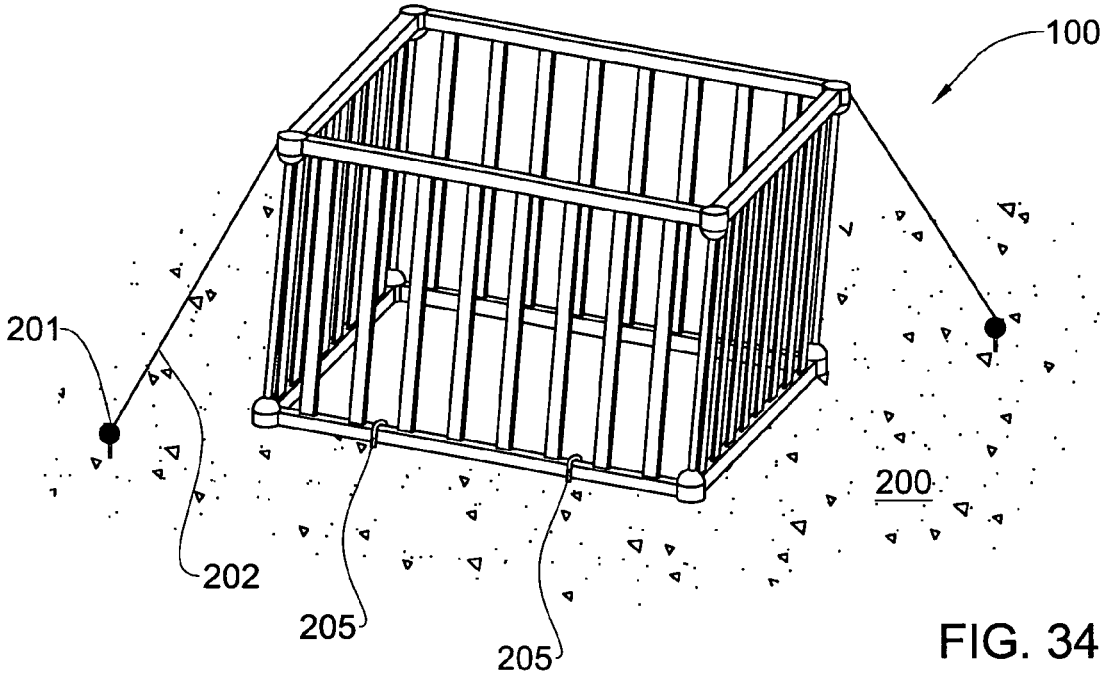
FIG. 34 illustrates in isometric view an infant enclosure secured onto the ground.
Figure 34A:
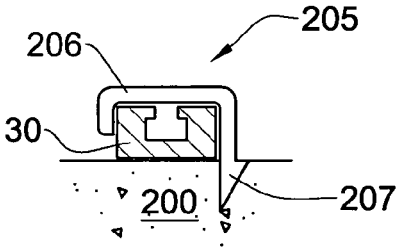
FIG. 34*a* illustrates in side view a peg used in securing an infant enclosure to the ground.

Alternatively, and as illustrated in FIG. 34, the enclosure may be mounted onto relatively soft ground, such as a grassy turf 200 or sand for example, by any suitable means. For example, pegs 201, such as for example tent pegs, may be hammered into the ground at some distance from the enclosure 10, and cables or string 202 secured to the upper portion of the enclosure 10 by suitable means (not shown) secure the enclosure to these pegs 201. Additionally or alternatively, and as illustrated in FIG. 34*a*, pegs in the form of an inverted J may directly secure the enclosure 10 to the ground 200. The round part 206 of the peg 205 is seated over a lower cross-member 30, in-between adjacent struts 42, and the spike 207 of the peg 205 is driven with force into the ground 200. A towel, cloth, mat, mattress or the like may be inserted into the enclosure 10 for infant comfort.

Figure 46:
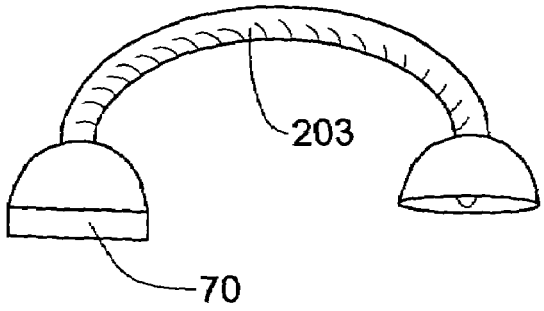
FIG. 46 illustrates in partial front view an optional night lamp accessory for use with the embodiment of FIG. 1.
Figure 46A:
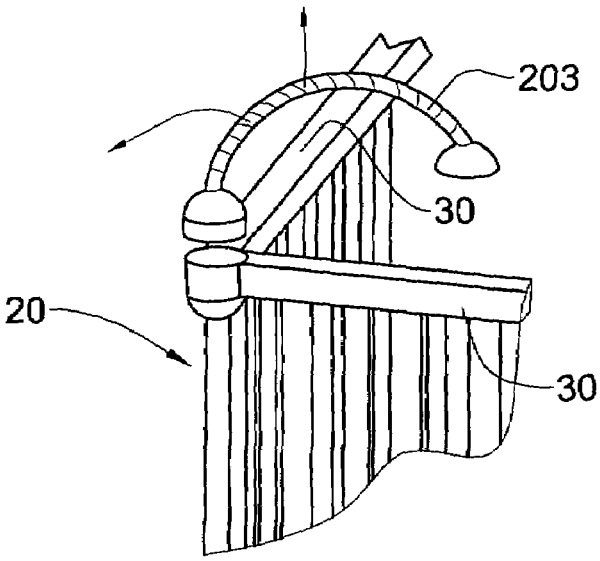
FIG. 46*a* illustrates a mounting configuration of the accessory of FIG. 46 with respect to the embodiment in FIG. 1.
Figure 47:
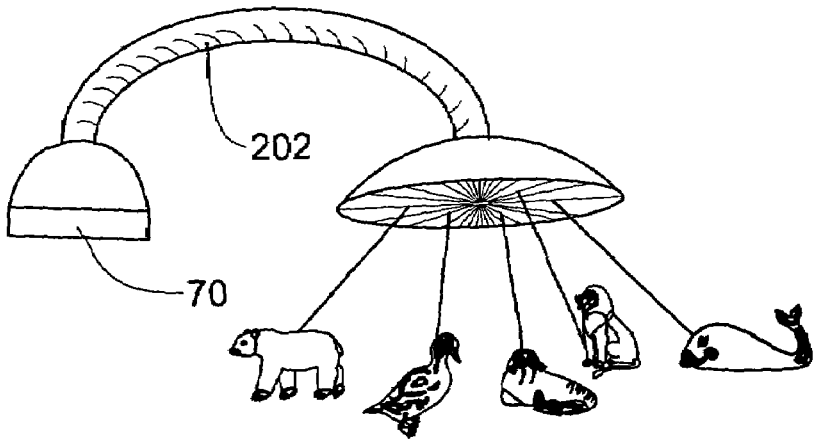
FIG. 47 illustrates in partial front view an optional mobile accessory for use with the embodiment of FIG. 1.

Optionally, one or more of the following accessories may be mounted to the enclosure 10 using any suitable mounting arrangement: a night light or lamp, a mobile, and active and/or passive play center, mirror, and so on. Further optionally, these accessories may be integrated in the structure of the enclosure 10. For example, the active and/or passive play center may be formed in a similar manner to the entertainment panel described herein with reference to FIG. 25, mutatis mutandis; the mirror may be integrated in a paneling bar, for example as described herein with reference to FIG. 21, mutatis mutandis. A mobile 202 and/or a night light 203 may each be mounted to or be integral with an upper facing clamping part 70, for example as illustrated in FIGS. 46, 46*a*, 47, in a similar to that described herein for legs 91 or wheels 92, with reference to FIGS. 35 and 36, respectively, mutatis mutandis.

Figure 31:
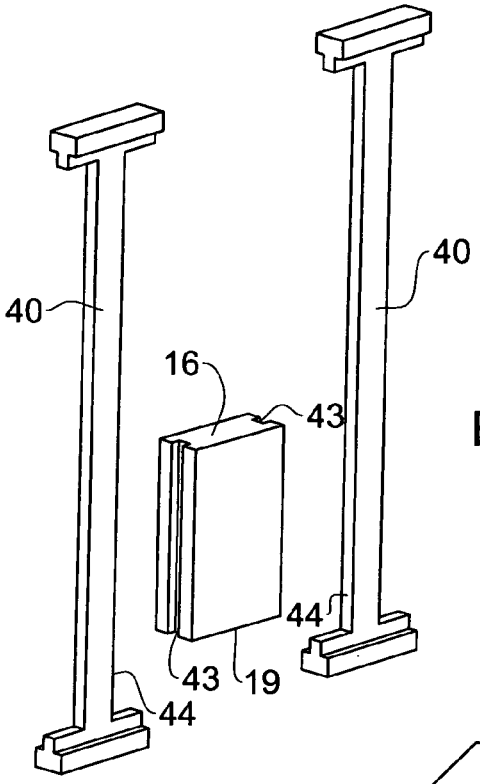
FIG. 31 illustrates in exploded view a spacing element and two adjacent bars.
Figure 32:
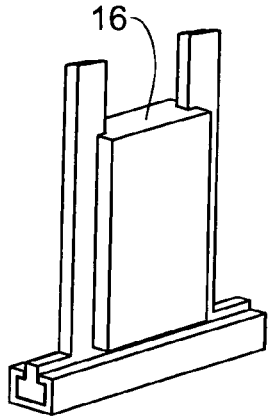
FIG. 32 illustrates the spacing element of FIG. 31 engaged between two adjacent bars.
Figure 33:
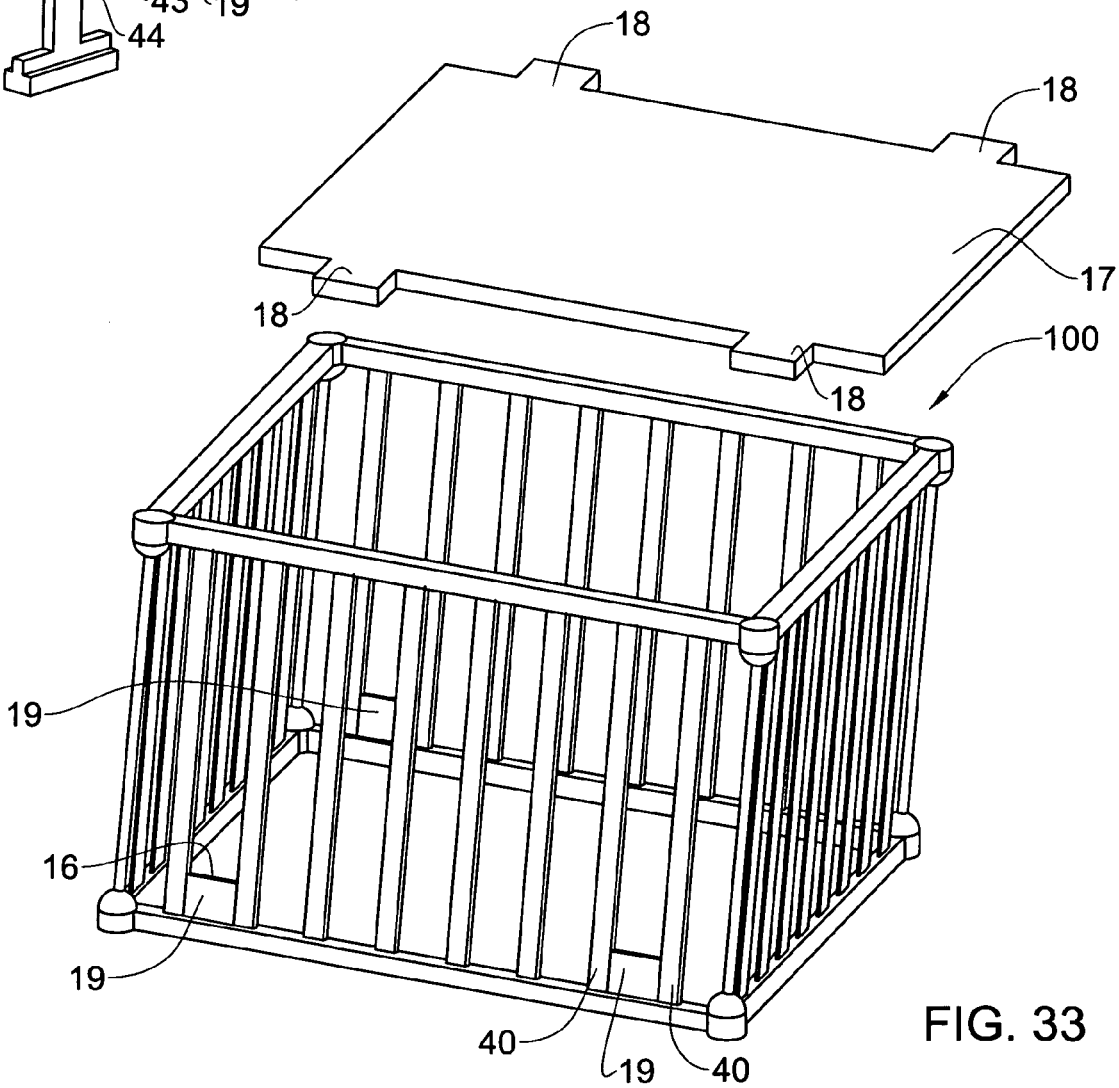
FIG. 33 illustrates an infant enclosure incorporating the spacing elements of FIGS. 31 and 32, and a platform suitable to be rested thereon.

Optionally, a support platform for supporting thereon a mattress, mat or the like within the enclosure 10 may be adapted for connection to the enclosure 10 at a series of different heights, according to need. For example, it may be desired to have the platform at a first height such that the platform is only say 20 cm from the top of the enclosure 10, to ease insertion and extraction of the infant, when the enclosure is used as a crib. On the other hand, a second, lower height may be desired when using the enclosure as a play pen, when the height of the panels 90 above the platform has to be sufficiently high to ensure that the infant cannot climb over the sides of the enclosure 10. Thus, referring to FIGS. 31 and 32, a number of vertical spacer members 19, typically four, may be provided, and each of which is adapted to be engaged within the gap between two the struts 42 of two adjacent bars 40 and the bottom cross-member 30. For this purpose, the opposed edges 43, 44 of struts 42 and spacer element 19 may be suitably contoured to facilitate this engagement. Referring to FIG. 33, a platform 17, having a perimeter such as to fit within the enclosure of the invention, further comprises tabs 18, typically integral with the platform 17, which are supported on the tops 16 of the spacer elements 19. The vertical height of the spacer elements 19 thus determines the height of the platform 17, and thus of the mattress that may be placed thereon. Accordingly, alternative sets of said spacer elements 19 may be provided, wherein each set comprises a plurality of spacer elements of a specific height. Typically, two or three different heights may be sufficient, and thus two or three sets of spacer elements may be required.

Alternatively, the auxiliary spacer members 31 may comprise a tab extending in the direction of the inside of the enclosure and adapted for supporting thereon a said platform, which then has no need for said tabs.

Figure 35:
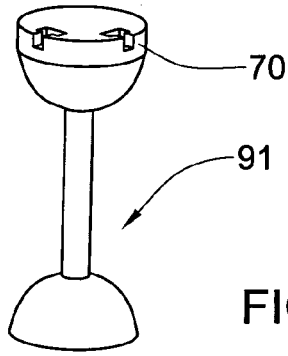
FIG. 35 illustrates in partial front view an optional leg accessory for use with the embodiment of FIG. 1.
Figure 36:
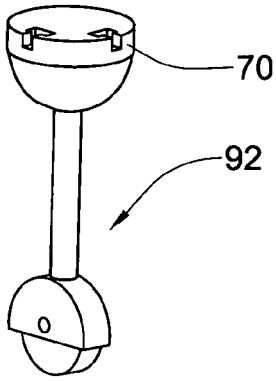
FIG. 36 illustrates in partial front view an optional wheel accessory for use with the embodiment of FIG. 1.
Figure 37:
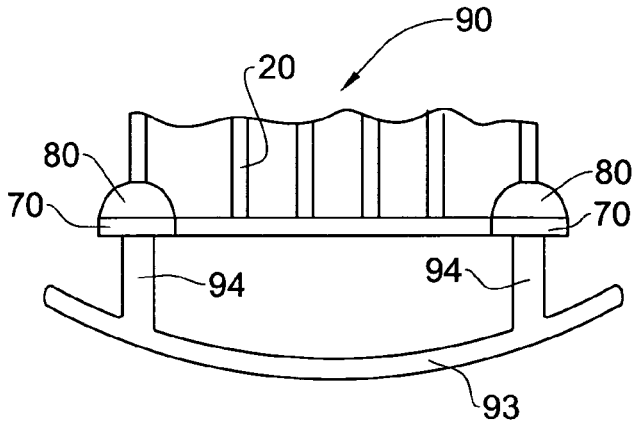
FIG. 37 illustrates in partial front view an optional arcuate base accessory for use with the embodiment of FIG. 1.

Referring to FIGS. 35 to 37, various optional attachments or accessories may be provided for the enclosure. For example, referring to FIGS. 35 and 36 respectively, legs 91 and/or wheels 92 may be provided, each being integral with or mountable with respect to the clamping parts 70 that are on the bottom of the infant enclosure. The legs 91 can be of any suitable height, allowing the overall height of the infant enclosure to be increased, while wheels 92 allow the enclosure to be easily moved. A combination of two legs and two wheels (having substantially equal heights) at the four corners of the enclosure may be used to great effect for providing a stable but easily transportable base.

In FIG. 37, another optional attachment is provided, in the form of an arcuate base 93, which is integral with or attachable to two adjacent bottom clamping parts 70 of the enclosure via struts 94. By providing a base 93 at each longitudinal end of the enclosure, this may be used as a rocking cradle for a baby, having previously provided a platform and mattress within the enclosure.

Figure 38:
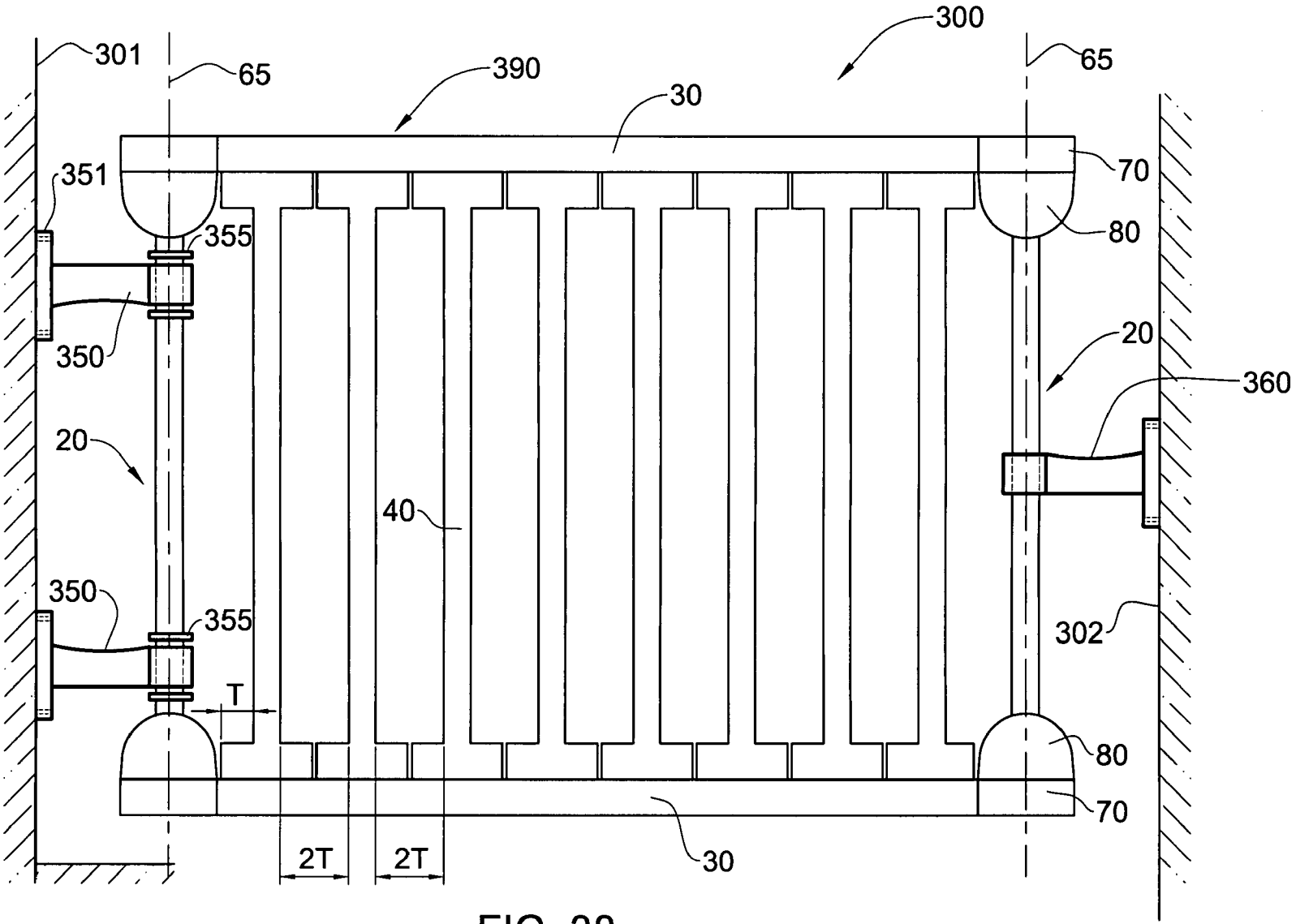
FIG. 38 is a front view of an infant safety gate according to a second aspect of the invention assembled from a kit comprising a plurality of parts illustrated in FIG. 1.
Figure 39:
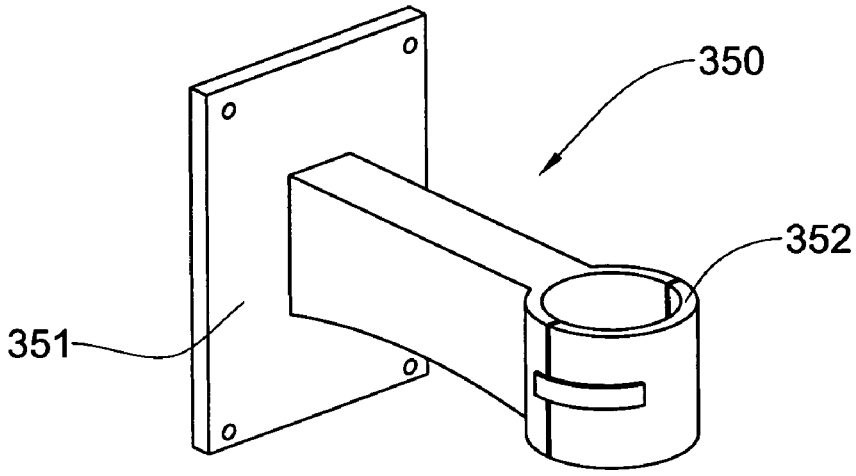
FIG. 39 illustrates in isometric view a hinge member of FIG. 38.
Figure 40:
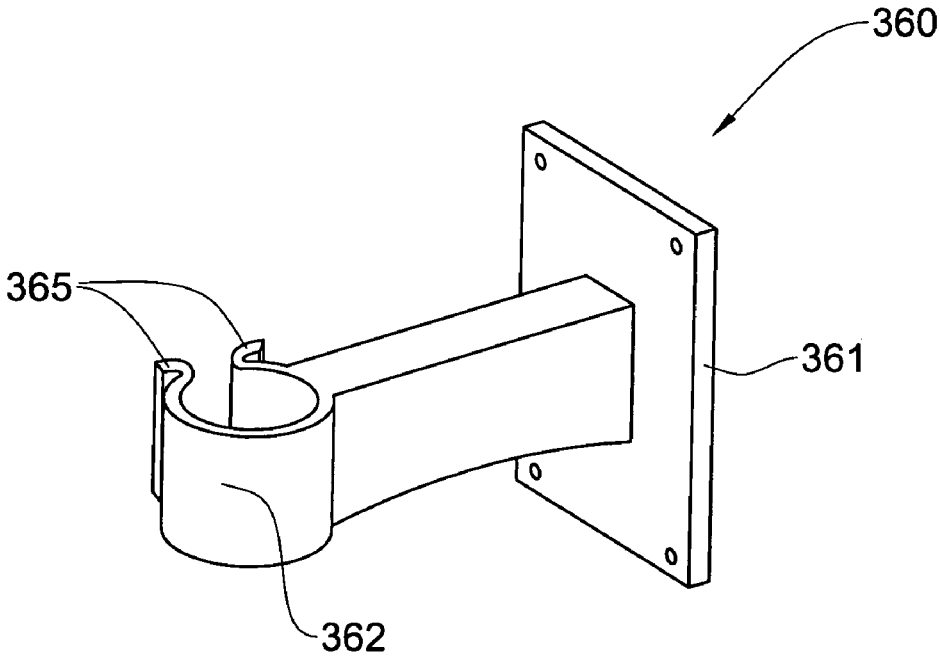
FIG. 40 illustrates in isometric view a latch member of FIG. 38 FIGS. 41*a* to 41*f* illustrate in plan view various modifications of a clamping part of the corner module of FIG. 1 used according to the third aspect of the present invention.

In a second aspect of the present invention, and referring to FIG. 38, the kit 50 may be used for the construction of a safety gate 300. Essentially, a panel 390 is assembled using a plurality of bars 40 engaged with respect to upper and lower cross-members 30, in a similar manner to that described above for panel 90, mutatis mutandis. Then, the engagement members 62 at the longitudinal ends of the cross-members 30 are locked in two corner modules 20, one on each longitudinal end of the panel 390. The length of the cross-members 30, and heights of bars 40 and corner modules 20, can be adjusted to provide the desired length and height of the gate 300, in a similar manner to that described above for the first aspect for the invention, mutatis mutandis. The gate 300 may then be secured at the desired location, for example at the top or bottom of stairs, as follows. For example and referring to FIGS. 38 and 39 typically two hinge members 350 are provided for hinging the gate 300 to a post or wall 301. The hinge members 350 comprise a bracket 351 adapted for securing to a wall 301, for example via screws, and a cylindrical element 352 for receiving upright 22 and allowing pivoting movement therebetween. Advantageously, the upright 22 may comprise ring like seats 355 for defining the relative position between the upright 22 and the members 35.0 in the axial direction. The cylindrical elements 352 may be integrally formed, and thus needs to be preassembled with respect to the upright 22 before the gate 300 is assembled. Alternatively, the cylindrical elements 350 are formed as two parts which may be reversibly joined to one another to allow connection to the upright 22 after assembly of the gate 300. Optionally, the two hinge elements 350 may be integrally joined to facilitate alignment thereof with respect to the wall 301. The gate 300 preferably further comprises at least one latch element 360, as illustrated in FIGS. 38 and 40. The latch element 360 cooperate with the other upright 22 to reversibly secure the gate 300 to an opposite post or wall 302. The latch member 360 may comprise a bracket 361 adapted for securing to a wall 302, for example via screws, and an Ω-shaped open cylindrical element 362 reversibly receiving and securing upright 22 via resilient arms 265. Of course, many other arrangements may be provided for pivotably securing and reversibly locking the gate 300.

In a third aspect of the invention, the kit 50 may be used in a modular manner to provide an enclosure of any desired shape and size, typically by providing an assortment of corner units 20, in particular, an assortment of interchangeable said clamping parts 70, as will be further described hereinbelow. Referring to FIGS. 41*a* to 41*f*, and 42, FIG. 42 shows a standard part 70 adapted for connecting two panels 90 at a 90° corner, as has been described above.

Figure 41A:
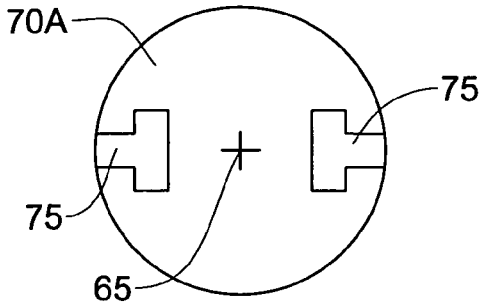

FIG. 41*a* shows a modified part 70A adapted for connecting two panels 90 in series, i.e., at an angle of 180°, wherein the engagement members 62 thereof are engaged in slots 75 which are disposed at 180° with respect to one another.

Figure 41B:
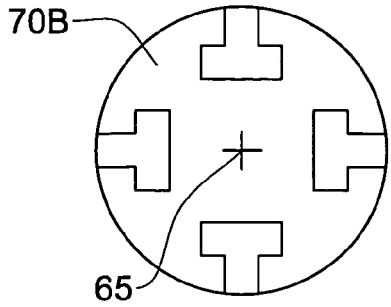

FIG. 41*b* shows a modified part 70B adapted for connecting up to four panels 90 orthogonally, and thus comprises four slots 75 at an angle of 90° between adjacent slots 75, for engaging the corresponding four engagement members 62 therein. However, the part 70B may also be used to connect two panels in series, as with part 70B, or in a 90° corner, as with part 70, by only using the desired two out of the four slots 75 that are available. Further, the part 70B may also be used to connect three panels 90 in a T-shape, by using any three of the four slots 75.

Figure 41C:
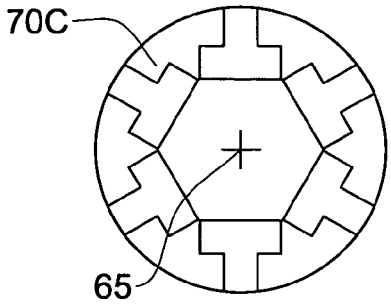
Figure 41D:
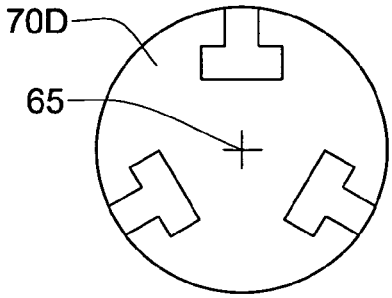
Figure 43:
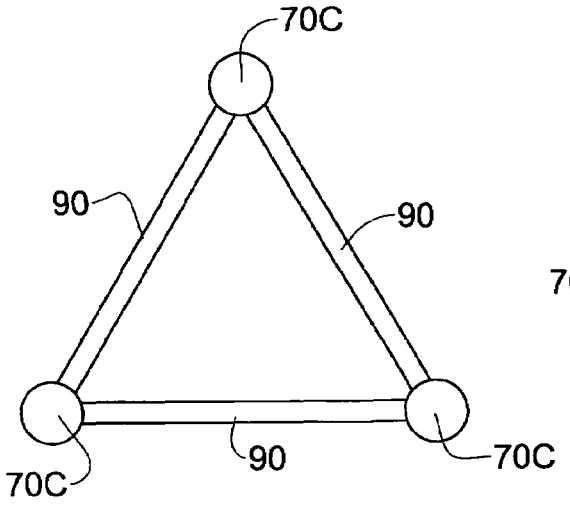
FIG. 43 is a plan view of an infant enclosure gate in triangular configuration according to a third aspect of the invention assembled from a kit comprising a plurality of parts illustrated in FIGS. 1 and 41*c*.
Figure 44:
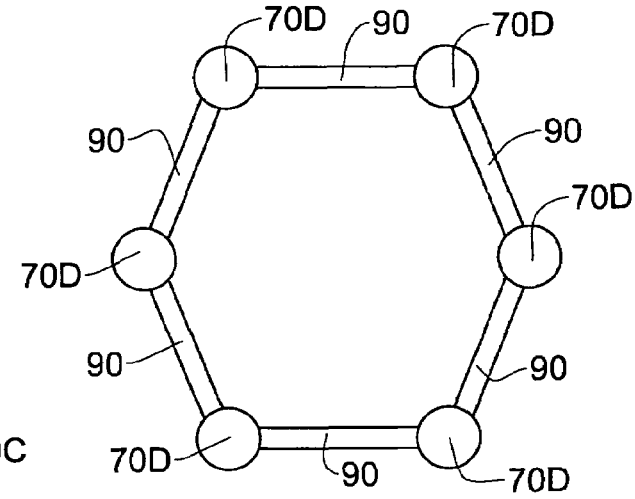
FIG. 44 is a plan view of an infant enclosure gate in hexagonal configuration according to a third aspect of the invention assembled from a kit comprising a plurality of parts illustrated in FIGS. 1 and 41*c* and/or 41*d*.

FIG. 41*c* shows another modified part 70C comprising six slots uniformly distributed about the axis 65, while FIG. 41*d* shows a modified part 70D comprising three slots uniformly distributed about the axis 65. Parts 70C and 70D are particularly useful for assembling enclosures in the form of a triangle or hexagon, as illustrated in FIGS. 43 and 44 respectively.

Figure 41E:
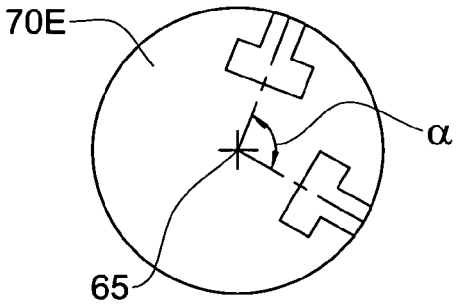

FIG. 41*e* shows another modified part 70E comprising two slots set at an angle α about axis 65, angle α being customized according to user requirements, for example. Of course, a plurality of different parts 70E may be provided, each of which may comprise any desired number of slots 75, and in any desired disposition.

Figure 41F:
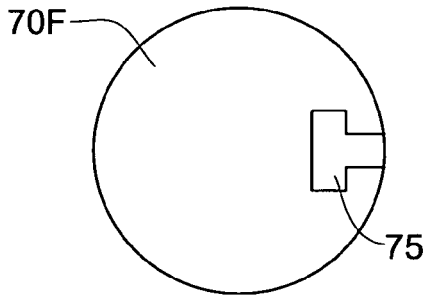
Figure 42:
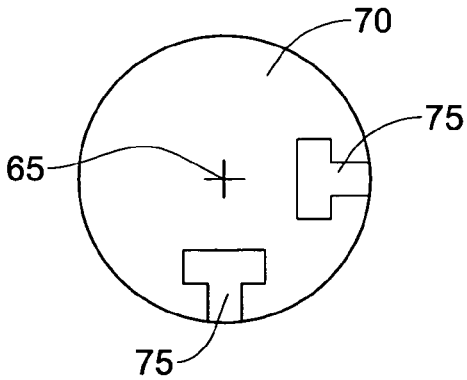
FIG. 42 illustrates in plan view a standard corner configuration of a clamping part of the corner module of FIG. 1.

FIG. 41*f* shows another modified part 70F, particularly useful for a gate or the like, as described with respect to the second aspect of the invention, in which the corner modules 20 are only required to be connected to a single panel assembly 390.

Figure 45:
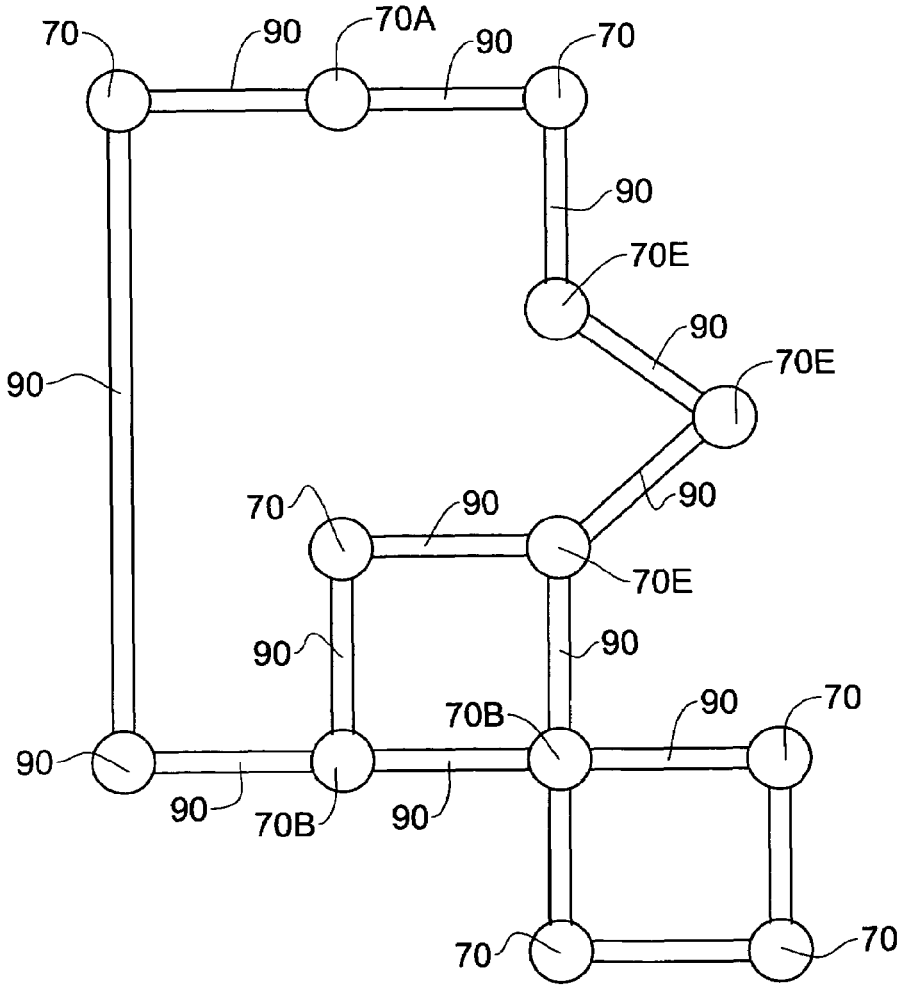
FIG. 45 is a plan view of an alternative infant enclosure gate according to a third aspect of the invention assembled from a kit comprising a plurality of parts illustrated in FIGS. 1, 41*a* to 41*f* and 42.

FIG. 45 illustrates an enclosure 10' made from a plurality of panel assemblies 90 joined by means of corner modules comprising various pats 70, 70A, 70B, 70E in a particular arrangement, and comprising a pair of sub enclosures 10" which may be useful for storing toys, clothing etc. Enclosure 10' is particular useful as a playpen for holding more than one infant herein, and is thus particularly advantageous in settings such as nurseries and the like.

Although the use of the kit 50 according to the second and third aspects of the invention have been illustrated with respect to said slot 75 in the form of a T, it is to be understood that they apply, mutatis mutandis, to any other form of connection between panel assemblies 90 or 390 and corner modules 20.

Thus, the present invention provides a kit for a variety of uses such as an safety gate or infant enclosure that may be assembled in an easy and simple manner from lightweight, though strong, sections that take up a relatively small volume in the disassembled state.

Thus, according to the invention, a kit is provided for enabling the assembly of structures useful for infants, for example playpens and cribs. The kit includes a plurality of cross-members, bars and corner modules. Each bar is in the form of at least one upright having spacer elements at longitudinal ends thereof. The cross-members have a longitudinal open slot for engaging a plurality of such bars via their spacer elements received in the slot serially. Each corner module is adapted for clamping together at least two said cross-members, or for retaining the spacer elements within the slot.

In the method claims that follow, alphanumeric characters and Roman numerals used to designate claim steps are provided for convenience only and do not imply any particular order of performing the steps.

Finally, it should be noted that the word "comprising" as used throughout the appended claims is to be interpreted to mean "including but not limited to".

While there has been shown and disclosed exemplary embodiments in accordance with the invention, it will be appreciated that many changes may be made therein without departing from the spirit of the invention.

The invention claimed is:

1. Kit for assembling structures useful for infants, comprising a plurality of cross-members, bars and corner modules, wherein:

each said bar comprises at least one upright having spacer elements at longitudinal ends thereof;

each said cross-member comprises a longitudinal open channel, extending uniformly from one longitudinal end thereof to another longitudinal end thereof, for engaging a plurality of said bars at one end thereof therewith, said channel configured for receiving therein a corresponding plurality of said spacer elements in series, each said cross-member being formed with a first engagement element at each longitudinal end thereof; and each said corner module comprising second engagement elements, and configured for clamping together at least two said cross-members thereto by engagement of said first engagement element of each of said at least two cross-members within said second engagement elements independently of said spacer elements, and wherein said corner modules are further configured for retaining said spacer elements longitudinally with respect to said channel of each of said at least two cross-members.

2. Kit according to claim 1, wherein said corner modules comprise a clamping arrangement comprising a pair of mutually engageable clamping members, wherein one said clamping member of each said pair comprises at least two suitable slots, each adapted for engaging a said engagement element of a different said cross-member.

3. Kit according to claim 2, wherein said cross-members comprise a substantially uniform transverse profile along a longitudinal length thereof between said engagement elements, and wherein optionally at least one of said channel and said engagement element, comprises a cross sectional profile including any one of: T-shaped, trapezoidal, circular, cross-shaped, crescent-shaped, asymmetrical, and so on.

4. Kit according to claim 2, wherein at least one said bar is in the form of any one of:

a substantially symmetrical H, wherein said spacer elements thereof are substantially orthogonal to said upright thereof; or a panel or net having a width substantially similar to the said spacer elements thereof; or a Z, wherein said spacer elements thereof are substantially parallel and aligned one to the other; or a substantially symmetrical U, wherein said spacer elements thereof are substantially orthogonal to said upright thereof; or a substantially asymmetrical H, wherein said spacer elements thereof are substantially orthogonal to said upright thereof.

5. Kit according to claim 2, wherein at least one said upright comprises a form selected from the group consisting of: wave, zig-zag, flower, toy, clown, teddy bears, tree, panel, slat, net, and mesh.

6. Kit according to claim 2, further comprising at least one of:

an entertainment panel comprising a width corresponding to a multiple of the width of a said bar, and further comprising spacer members for engagement with said cross-members;

a plurality of auxiliary spacer element adapted for being engaged between two adjacent said bars and having a longitudinal length smaller than the longitudinal length of said bars, and a platform having a plurality of tabs adapted for being seated onto said auxiliary spacer elements when an infant enclosure is assembled comprising said auxiliary spacer elements;

any one of leg elements, wheel elements and an arcuate base, each adapted for connection to said corner modules, for supporting an enclosure made by suitably assembling elements of said kit.

7. Kit according to claim 2, comprising at least one type of a plurality of types of said corner module, each said type of corner module comprising a clamping arrangement comprising a pair of mutually engageable clamping members and wherein one said clamping member of each said pair comprises a particular slot arrangement comprising at least one slot, each slot adapted for engaging a said engagement element of a corresponding said cross-member in a particular orientation with respect to the clamping member.

8. Kit for assembling structures useful for infants, comprising a plurality of cross-members, bars and corner modules, wherein:

each said bar comprises at least one upright having spacer elements at longitudinal ends thereof;

each said cross-member comprises a longitudinal open channel for engaging a plurality of said bars at one end thereof therewith, said channel adapted for receiving therein a corresponding plurality of said spacer elements in series; and each said corner module is adapted for clamping together at least two said cross-members, wherein said cross-members comprise an engagement element at each longitudinal end thereof, and wherein said corner modules comprise a clamping arrangement comprising a pair of mutually engageable clamping members, wherein one said clamping member of each said pair comprises at least two suitable slots, each adapted for engaging a said engagement element of a corresponding said cross-member; and wherein said corner modules comprise a strut element comprising at each longitudinal end thereof a said clamping arrangement.

9. Kit for assembling structures useful for infants, comprising a plurality of cross-members, bars and corner modules, wherein:

each said bar comprises an upright having spacer elements at longitudinal ends thereof;

each said cross-member comprises a longitudinal open channel, extending uniformly from one longitudinal end thereof to another longitudinal end thereof, for engaging a plurality of said bars at one end thereof therewith, said channel configured for receiving therein a corresponding plurality of said spacer elements in series, each said cross-member being formed with a first engagement element at each longitudinal end thereof;

each said corner module comprising second engagement elements and a clamping arrangement configured for engagement of a respective said first engagement element of at least one cross-member within said second engagement elements independently of said spacer elements, and for thereby retaining said spacer elements longitudinally with respect to said channel.

10. Kit according to claim 9, further comprising hinge members adapted for cooperating with said corner modules for enabling said corner modules to pivot with respect to said hinge members when assembled therewith, said hinge members further adapted for mounting to a substantially vertical surface.

11. Kit according to claim 9, further comprising latch members adapted for cooperating with said corner modules for enabling said corner modules to be restrained with respect to said latch members when engaged therewith, said latch members further adapted for mounting to a substantially vertical surface.

12. A structure useful for infants, said structure comprising an assembly of bars, cross-members and corner modules, wherein each said bar comprises at least one upright having spacer elements at longitudinal ends thereof;

each said cross-member comprises a longitudinal open channel, extending uniformly from one longitudinal end thereof to another longitudinal end thereof, for engaging a plurality of said bars at one end thereof therewith, said channel configured for receiving therein a corresponding plurality of said spacer elements in series, each said cross-member being formed with a first engagement element at each longitudinal end thereof;

each said corner module comprising second engagement elements, and configured for clamping together at least two said cross-members thereto by engagement of a respective said first engagement element of each of said at least two cross-members within said second engagement elements independently of said spacer elements, and wherein said corner modules are further configured for retaining said spacer elements longitudinally with respect to said channel of each of said at least two cross-members; and wherein said structure comprises a plurality of panel assemblies joined by means of said corner modules, wherein each said panel assembly comprises a plurality of said bars serially engaged longitudinally with respect to a pair of spaced said cross-members by means of engagement of the said spacer elements of each said bar with a channel of one or another of said cross-members.

13. Structure according to claim 12, wherein said structure is in the form of an enclosure comprising a plurality of said panel assemblies in polygonal formation joined at the corners thereof via suitable said corner modules.

14. Structure according to claim 13, wherein said enclosure is rectangular in plan form, and said corner modules are adapted for connecting at least two said adjacent panel assemblies.

15. Structure according to claim 14, further comprising a strap arrangement attached to a bottom end of said enclosure and adapted for securing the enclosure to a bed or other raised platform.

16. Structure according to claim 14, further comprising suitable pegs for securing a bottom end of said enclosure to soft ground.

17. Structure according to claim 14, further comprising a base suitably secured to said enclosure.

18. Structure according to claim 14, further comprising at least one accessory take from: a night light, a mobile, and active and/or passive play center, mirror.

19. Structure according to claim 18, wherein said accessory is integrated with respect to a said bar or said corner module.

20. An element adapted for use in the assembly of structures useful for infants, said element comprising any one of a cross-member, a bar and a corner module, wherein:

said bar comprises an upright having spacer elements at longitudinal ends thereof, said spacer elements being adapted for being engaged in a longitudinal open channel of a cross-member;

said cross-member comprises a longitudinal open channel, extending uniformly from one longitudinal end thereof to another longitudinal end thereof, for engaging a plurality of bars having spacer elements at the ends thereof via said spacer elements, said channel configured for receiving therein a corresponding plurality of said spacer elements in series, said cross-member further comprising a first engagement element at each longitudinal end thereof; and said corner module comprising a second engagement element, and a clamping arrangement comprising a pair or mutually engageable clamping members, wherein one said clamping member of each said pair comprises at least two suitable slots, each said slot configured for engaging said first engagement element of the respective said cross-member within said second engagement element independently of said spacer elements.

21. A method for assembling a structure useful for infants, comprising:

(i) providing a plurality of bars, cross-members and corner modules, wherein:

each said bar comprises an upright having spacer elements at longitudinal ends thereof;

each said cross-member comprises a longitudinal open channel, extending uniformly from one longitudinal end thereof to another longitudinal end thereof, for engaging a plurality of said bars at one end thereof therewith, said channel configured for receiving therein a corresponding plurality of said spacer elements in series, each said cross-member being formed with a first engagement element at each longitudinal end thereof;

each said corner module comprising second engagement elements, and configured for clamping together at least two said cross-members thereto by engagement of a respective said first engagement element of each of said at least two cross-members within said second engagement elements independently of said spacer elements, and wherein said corner modules are further configured for retaining said spacer elements longitudinally with respect to said channel of each of said at least two cross-members;

(ii) assembling a plurality of panel assemblies by serially engaging a plurality of said bars longitudinally with respect to a pair of spaced said cross-members by means of engagement of the said spacer elements of each said bar with a channel of one or another of said cross-members; and (iii) joining each pair of adjacent said panel assemblies by means of said corner modules.

22. Kit for assembling structures useful for infants, comprising a plurality of cross-members, bars and corner modules, wherein:

each said bar comprises at least one upright having spacer elements at longitudinal ends thereof;

each said cross-member comprises a longitudinal open channel, extending uniformly from one longitudinal end thereof to another longitudinal end thereof, for engaging a plurality of said bars at one end thereof therewith, said channel configured for receiving therein a corresponding plurality of said spacer elements in series; and each said corner module is configured for clamping together at least two said cross-members thereto by engagement of substantially only a respective said longitudinal end of each of said at least two cross-members within the or each said corner module independently of the respective said spacer elements, and wherein said corner modules are further configured for retaining said spacer elements longitudinally with respect to said channel of each of said at least two cross-members.

* * * * *